US011530892B2

(12) United States Patent
Gomez

(10) Patent No.: US 11,530,892 B2
(45) Date of Patent: Dec. 20, 2022

(54) BARREL NUT ASSEMBLY AND METHOD TO ATTACH A BARREL TO A FIREARM USING SUCH ASSEMBLY

(71) Applicant: LWRC International LLC, Cambridge, MD (US)

(72) Inventor: Jesus S. Gomez, Trappe, MD (US)

(73) Assignee: LWRC International LLC, Cambridge, MD (US)

( * ) Notice: Subject to any disclaimer, the term of this patent is extended or adjusted under 35 U.S.C. 154(b) by 0 days.

(21) Appl. No.: 16/916,026

(22) Filed: Jun. 29, 2020

(65) Prior Publication Data

US 2021/0156638 A1 May 27, 2021

Related U.S. Application Data

(60) Division of application No. 15/332,143, filed on Oct. 24, 2016, now Pat. No. 10,697,726, which is a continuation of application No. 13/738,894, filed on Jan. 10, 2013, now Pat. No. 9,506,711, which is a continuation-in-part of application No. 13/562,651, filed on Jul. 31, 2012, now Pat. No. 9,816,546.

(51) Int. Cl.
*F41A 21/48* (2006.01)
*F41A 5/26* (2006.01)

(52) U.S. Cl.
CPC ..... *F41A 21/48* (2013.01); *F41A 5/26* (2013.01); *Y10T 29/49895* (2015.01)

(58) Field of Classification Search
CPC .... F41A 5/26; F41A 11/00; F41A 21/48–487; Y10T 29/49895
USPC ..... 29/464; 42/75.01–75.2, 75.1, 108
See application file for complete search history.

(56) References Cited

U.S. PATENT DOCUMENTS

| | | | |
|---|---|---|---|
| 894,530 | A | 7/1908 | Punches |
| 1,348,702 | A | 8/1920 | Gabbett-Fairfax |
| 1,348,733 | A | 8/1920 | Pedersen |
| 1,384,161 | A | 7/1921 | Schwinzer |
| 1,568,005 | A | 12/1925 | Sutter |
| 1,737,974 | A | 12/1929 | Pedersen |
| 1,797,951 | A | 3/1931 | Gaidos |

(Continued)

FOREIGN PATENT DOCUMENTS

| | | |
|---|---|---|
| WO | WO-95/08090 | 3/1995 |
| WO | WO-2008/108804 | 9/2008 |

OTHER PUBLICATIONS

U.S. Appl. No. 12/381,240 filed Mar. 10, 2009, Gomez.

(Continued)

*Primary Examiner* — Joshua E Freeman
*Assistant Examiner* — Benjamin S Gomberg
(74) *Attorney, Agent, or Firm* — Arnall Golden Gregory LLP

(57) ABSTRACT

A fixture for use with AR15/M16 type firearms is provided herein. The fixture is made up of several parts that when used in conjunction with one another mitigate the transfer of torque from the barrel nut to the firearms receiver during barrel installation. The fixture affords the user a method and apparatus that holds the barrel in alignment with the firearm receiver and secures the barrel against rotational movement during installation of a barrel nut or similar device. The fixture may be configured to work with the legacy AR15/M16 type barrel nut, as well as other designs as disclosed herein.

3 Claims, 28 Drawing Sheets

(56) References Cited

U.S. PATENT DOCUMENTS

| | | | |
|---|---|---|---|
| 1,994,489 | A | 3/1935 | Simpson |
| 2,090,656 | A | 8/1937 | Williams |
| 2,100,410 | A | 11/1937 | Pugsley |
| 2,137,491 | A | 11/1938 | Huff |
| 2,275,213 | A | 3/1942 | Wise |
| 2,336,146 | A | 12/1943 | Williams |
| 2,377,692 | A | 6/1945 | Johnson, Jr. |
| 2,424,194 | A | 7/1947 | Sampson et al. |
| 2,426,563 | A | 8/1947 | Patchett |
| 2,482,758 | A | 9/1949 | Gaidos |
| 2,532,794 | A | 12/1950 | Teece |
| 2,611,297 | A | 9/1952 | Simpson |
| 2,655,754 | A | 10/1953 | Brush |
| 2,858,741 | A | 11/1958 | Simpson |
| 2,872,849 | A | 2/1959 | Simpson |
| 2,910,795 | A | 11/1959 | Agren |
| 2,952,934 | A | 9/1960 | Yovanovitch |
| 2,971,441 | A | 2/1961 | Reed |
| 3,027,672 | A | 4/1962 | Sullivan |
| 3,137,958 | A | 6/1964 | Lewis et al. |
| 3,176,424 | A | 4/1965 | Hoge |
| 3,301,133 | A | 1/1967 | Sturtevant |
| 3,366,011 | A | 1/1968 | Sturtevant |
| 3,446,114 | A | 5/1969 | Ketterer |
| 3,453,762 | A | 7/1969 | Fremont |
| 3,570,162 | A | 3/1971 | Suddarth |
| 3,618,455 | A | 11/1971 | Plumer et al. |
| 3,618,457 | A | 11/1971 | Miller |
| 3,630,119 | A | 12/1971 | Perrine |
| 3,636,647 | A | 1/1972 | Goldin |
| 3,675,534 | A | 7/1972 | Beretta |
| 3,771,415 | A | 11/1973 | Into et al. |
| 3,776,095 | A | 12/1973 | Atchisson |
| 3,803,739 | A | 4/1974 | Haines et al. |
| 3,857,323 | A | 12/1974 | Ruger et al. |
| 3,869,961 | A | 3/1975 | Kawamura |
| 3,977,296 | A | 8/1976 | Silsby et al. |
| 4,016,667 | A | 4/1977 | Forbes |
| 4,028,993 | A | 6/1977 | Reynolds |
| 4,057,003 | A | 11/1977 | Atchisson |
| 4,128,042 | A | 12/1978 | Atchisson |
| 4,226,041 | A | 10/1980 | Goodworth |
| 4,231,177 | A | 11/1980 | Foote |
| 4,244,273 | A | 1/1981 | Langendorfer, Jr. et al. |
| 4,279,191 | A | 7/1981 | Johansson |
| 4,416,186 | A | 11/1983 | Sullivan |
| 4,433,610 | A | 2/1984 | Tatro |
| 4,475,437 | A | 10/1984 | Sullivan |
| 4,502,367 | A | 3/1985 | Sullivan |
| 4,503,632 | A | 3/1985 | Cuevas |
| 4,505,182 | A | 3/1985 | Sullivan |
| 4,553,469 | A | 11/1985 | Atchisson |
| 4,563,937 | A | 1/1986 | White |
| H107 | H | 8/1986 | Bauer |
| D285,236 | S | 8/1986 | Brunton |
| 4,654,993 | A | 4/1987 | Atchisson |
| 4,658,702 | A | 4/1987 | Tatro |
| 4,663,875 | A | 5/1987 | Tatro |
| 4,677,897 | A | 7/1987 | Barrett |
| 4,688,344 | A | 8/1987 | Kim |
| 4,693,170 | A | 9/1987 | Atchisson |
| 4,702,146 | A | 10/1987 | Ikeda et al. |
| 4,735,007 | A | 4/1988 | Gal |
| 4,765,224 | A | 8/1988 | Morris |
| 4,872,279 | A | 10/1989 | Boat |
| 4,893,426 | A | 1/1990 | Bixler |
| 4,893,547 | A | 1/1990 | Atchisson |
| 5,038,666 | A | 8/1991 | Major |
| 5,117,735 | A | 6/1992 | Flashkes |
| 5,173,564 | A | 12/1992 | Hammond, Jr. |
| 5,183,959 | A | 2/1993 | McCoan et al. |
| 5,198,600 | A | 3/1993 | E'Nama |
| 5,272,956 | A | 12/1993 | Hudson |
| 5,343,650 | A | 9/1994 | Swan |
| 5,351,598 | A | 10/1994 | Schuetz |
| 5,412,895 | A | 5/1995 | Krieger |
| 5,448,940 | A | 9/1995 | Schuetz et al. |
| 5,452,534 | A | 9/1995 | Lambie |
| 5,551,179 | A | 9/1996 | Young |
| 5,565,642 | A | 10/1996 | Heitz |
| 5,590,484 | A | 1/1997 | Mooney et al. |
| 5,634,288 | A | 6/1997 | Martel |
| 5,678,343 | A | 10/1997 | Menges et al. |
| 5,726,377 | A | 3/1998 | Harris et al. |
| 5,770,814 | A | 6/1998 | Ealovega |
| 5,806,224 | A | 9/1998 | Hager |
| 5,826,363 | A | 10/1998 | Olson |
| 5,827,992 | A | 10/1998 | Harris et al. |
| 5,900,577 | A | 5/1999 | Robinson et al. |
| 5,907,919 | A | 6/1999 | Keeney |
| 6,019,024 | A | 2/2000 | Robinson et al. |
| 6,070,352 | A | 6/2000 | Daigle |
| 6,071,523 | A | 6/2000 | Mehta et al. |
| 6,134,823 | A | 10/2000 | Griffin |
| 6,182,389 | B1 | 2/2001 | Lewis |
| 6,227,098 | B1 | 5/2001 | Mason |
| 6,311,603 | B1 | 11/2001 | Dunlap |
| 6,382,073 | B1 | 5/2002 | Beretta |
| 6,418,655 | B1 | 7/2002 | Kay |
| 6,508,027 | B1 | 1/2003 | Kim |
| 6,536,153 | B2 | 3/2003 | Lindsey |
| 6,564,492 | B2 | 5/2003 | Weldle et al. |
| 6,606,812 | B1 | 8/2003 | Gwinn, Jr. |
| 6,634,274 | B1 | 10/2003 | Herring |
| 6,651,371 | B2 | 11/2003 | Fitzpatrick et al. |
| 6,655,069 | B2 | 12/2003 | Kim |
| 6,655,372 | B1 | 12/2003 | Field et al. |
| 6,668,815 | B1 | 12/2003 | Fernandez |
| 6,671,990 | B1 | 1/2004 | Booth |
| 6,681,677 | B2 | 1/2004 | Herring |
| 6,718,680 | B2 | 4/2004 | Roca et al. |
| 6,722,255 | B2 | 4/2004 | Herring |
| 6,792,711 | B2 | 9/2004 | Battaglia |
| 6,820,533 | B2 | 11/2004 | Schuerman |
| 6,829,974 | B1 | 12/2004 | Gwinn, Jr. |
| 6,848,351 | B1 | 2/2005 | Davies |
| 6,851,346 | B1 | 2/2005 | Herring |
| 6,901,691 | B1 | 6/2005 | Little |
| 6,945,154 | B1 | 9/2005 | Luth |
| 6,959,509 | B2 | 11/2005 | Vais |
| 6,971,202 | B2 | 12/2005 | Bender |
| 7,036,259 | B2 | 5/2006 | Beretta |
| 7,082,709 | B2 | 8/2006 | Lindsey |
| 7,131,228 | B2 | 11/2006 | Hochstrate et al. |
| 7,137,217 | B2 | 11/2006 | Olson et al. |
| 7,162,822 | B1 | 1/2007 | Heayn et al. |
| 7,213,498 | B1 | 5/2007 | Davies |
| 7,216,451 | B1 | 5/2007 | Troy |
| 7,219,462 | B2 | 5/2007 | Finn |
| 7,231,861 | B1 | 6/2007 | Gauny et al. |
| 7,243,453 | B2 | 7/2007 | McGarry |
| 7,299,737 | B2 | 11/2007 | Hajjar et al. |
| 7,313,883 | B2 | 1/2008 | Leitner-Wise |
| 7,316,091 | B1 | 1/2008 | Desomma |
| 7,398,616 | B1 | 7/2008 | Weir |
| 7,428,795 | B2 | 9/2008 | Herring |
| 7,444,775 | B1 | 11/2008 | Schuetz |
| 7,461,581 | B2 | 12/2008 | Leitner-Wise |
| 7,478,495 | B1 | 1/2009 | Alzamora et al. |
| 7,497,044 | B2 | 3/2009 | Cammenga et al. |
| D590,473 | S | 4/2009 | Fitzpatrick et al. |
| 7,533,598 | B1 | 5/2009 | Murphy |
| D603,012 | S | 10/2009 | Fitzpatrick et al. |
| 7,596,900 | B2 | 10/2009 | Robinson et al. |
| 7,634,959 | B2 | 12/2009 | Frickey |
| 7,661,219 | B1 | 2/2010 | Knight, Jr. et al. |
| 7,698,844 | B2 | 4/2010 | Gruber et al. |
| 7,707,762 | B1 | 5/2010 | Swan |
| 7,715,865 | B2 | 5/2010 | Camp, Jr. |
| 7,716,865 | B2 | 5/2010 | Daniel et al. |
| 7,735,410 | B2 | 6/2010 | Clark |
| 7,743,542 | B1 | 6/2010 | Novak |
| 7,762,018 | B1 | 7/2010 | Fitzpatrick et al. |
| 7,775,150 | B2 | 8/2010 | Hochstrate et al. |

(56) References Cited

U.S. PATENT DOCUMENTS 7,784,211 B1 8/2010 Desomma
7,793,453 B1 9/2010 Sewell, Jr. et al.
7,806,039 B1 10/2010 Gomex
7,827,722 B1 11/2010 Davies
7,832,326 B1 11/2010 Barrett
7,886,470 B1 2/2011 Doiron
D636,043 S 4/2011 Olsen et al.
7,930,968 B2 4/2011 Giefing
7,963,203 B1 6/2011 Davies
7,966,760 B2 6/2011 Fitzpatrick et al.
7,966,761 B1 6/2011 Kuczynko et al.
D641,451 S 7/2011 Gomez et al.
7,975,595 B2 7/2011 Robinson et al.
8,037,806 B2 10/2011 Davies
8,051,595 B2 11/2011 Hochstrate et al.
8,061,072 B1 11/2011 Crose
8,069,604 B2 * 12/2011 Larue ..... F41A 21/482 42/75.1
8,141,285 B2 3/2012 Brown
8,141,289 B2 3/2012 Gomez et al.
8,181,563 B1 5/2012 Peterken
8,186,090 B1 5/2012 Chiarolanza et al.
8,209,896 B1 7/2012 Cashwell
8,234,808 B2 8/2012 Lewis et al.
8,245,427 B2 8/2012 Gomez
8,245,429 B2 8/2012 Kuczynko et al.
D668,311 S 10/2012 Rogers et al.
8,307,750 B2 11/2012 Vuksanovich et al.
D674,859 S 1/2013 Robbins et al.
8,341,868 B2 1/2013 Zusman
8,342,075 B2 1/2013 Gomez
8,375,616 B2 2/2013 Gomez et al.
8,387,513 B2 3/2013 Gomez et al.
8,393,107 B2 3/2013 Brown
8,397,415 B2 3/2013 Laney et al.
8,418,389 B1 4/2013 Lukman et al.
8,434,252 B2 5/2013 Holmberg
8,468,929 B2 6/2013 Larson et al.
8,479,429 B2 7/2013 Barrett et al.
8,516,731 B2 8/2013 Cabahug et al.
8,539,708 B2 9/2013 Kenney et al.
8,561,335 B2 10/2013 Brown
8,631,601 B2 1/2014 Langevin et al.
8,689,477 B2 4/2014 Gomez et al.
8,689,672 B2 4/2014 Cassels
8,726,559 B1 5/2014 Mueller
8,746,125 B2 6/2014 Gomez et al.
8,769,855 B2 7/2014 Law
8,783,159 B2 7/2014 Gomez et al.
8,806,792 B2 8/2014 Yan et al.
8,806,793 B2 8/2014 Daniel et al.
D712,998 S 9/2014 Gomez
8,844,424 B2 9/2014 Gomez
8,863,426 B1 10/2014 Zinsner
8,887,426 B2 11/2014 Feese et al.
8,899,142 B1 12/2014 Cassels
8,943,947 B2 2/2015 Gomez
8,950,312 B2 2/2015 Gomez
8,955,422 B1 2/2015 Schumacher
8,966,800 B1 3/2015 Olson
8,978,284 B1 3/2015 Zusman
9,010,009 B2 4/2015 Buxton
9,038,304 B1 5/2015 Hu
D735,288 S 7/2015 Gomez
9,103,611 B2 8/2015 Neitzling
9,121,663 B2 9/2015 Troy et al.
9,140,506 B2 9/2015 Gomez
9,234,713 B1 1/2016 Olson
9,261,324 B1 2/2016 Liang et al.
9,291,414 B2 3/2016 Gomez
9,297,609 B2 3/2016 Burt
9,316,459 B2 4/2016 Troy et al.
9,347,738 B1 5/2016 Schumacher
9,395,148 B1 7/2016 Huang
9,404,708 B1 8/2016 Chow et al.
9,506,702 B2 11/2016 Visinski et al.
9,506,704 B2 11/2016 Gomez
9,506,711 B2 11/2016 Gomez
9,625,232 B2 4/2017 Gomez
9,658,011 B2 5/2017 Gomez
9,726,445 B2 8/2017 Gomez
9,766,034 B2 9/2017 Huang et al.
9,772,150 B2 9/2017 Gomez
9,810,495 B2 11/2017 Gomez
9,816,546 B2 11/2017 Gomez
9,857,129 B1 1/2018 Kelly et al.
9,915,497 B2 3/2018 Gomez
10,054,394 B2 8/2018 Jen et al.
10,060,699 B1 8/2018 Hu
10,240,883 B2 3/2019 Gomez
10,309,739 B2 6/2019 Gomez
10,323,891 B1 6/2019 Zheng
10,532,447 B2 1/2020 Hamby
10,591,245 B2 3/2020 Gomez
10,598,452 B2 3/2020 Gomez
10,690,425 B2 6/2020 Cassels
10,697,726 B2 6/2020 Gomez
10,808,748 B2 10/2020 Gomez
10,895,430 B2 1/2021 Gomez
2003/0089014 A1 5/2003 Schuerman
2003/0101631 A1 6/2003 Fitzpatrick et al.
2003/0110675 A1 6/2003 Garrett et al.
2003/0126781 A1 7/2003 Herring
2003/0136041 A1 7/2003 Herring
2004/0020092 A1 2/2004 Christensen
2004/0049964 A1 3/2004 Vais
2004/0055200 A1 3/2004 Fitzpatrick et al.
2005/0011345 A1 1/2005 Herring
2005/0011346 A1 1/2005 Wolff et al.
2005/0016374 A1 1/2005 Pescini
2005/0115140 A1 6/2005 Little
2005/0183310 A1 8/2005 Finn
2005/0183317 A1 8/2005 Finn
2005/0188590 A1 9/2005 Baber et al.
2005/0223613 A1 10/2005 Bender
2005/0262752 A1 12/2005 Robinson et al.
2006/0026883 A1 2/2006 Hochstrate et al.
2006/0065112 A1 3/2006 Kuczynko et al.
2006/0283067 A1 12/2006 Herring
2007/0012169 A1 1/2007 Gussalli Beretta et al.
2007/0033850 A1 2/2007 Murello et al.
2007/0033851 A1 2/2007 Hochstrate et al.
2007/0051236 A1 3/2007 Groves et al.
2007/0199435 A1 8/2007 Hochstrate et al.
2007/0234897 A1 10/2007 Poff
2008/0016684 A1 1/2008 Olechnowicz et al.
2008/0029076 A1 2/2008 Liang
2008/0092422 A1 4/2008 Daniel et al.
2008/0092733 A1 4/2008 Leitner-Wise et al.
2008/0276797 A1 11/2008 Leitner-Wise
2009/0000173 A1 1/2009 Robinson et al.
2009/0007477 A1 1/2009 Robinson et al.
2009/0031606 A1 2/2009 Robinson et al.
2009/0031607 A1 2/2009 Robinson et al.
2009/0107023 A1 4/2009 Murphy
2009/0151213 A1 6/2009 Bell
2009/0178325 A1 7/2009 Veilleux
2010/0071246 A1 3/2010 Vesligai
2010/0122483 A1 5/2010 Clark
2010/0126054 A1 5/2010 Daniel et al.
2010/0154275 A1 6/2010 Faifer
2010/0162604 A1 7/2010 Dubois
2010/0186276 A1 7/2010 Herring
2010/0205846 A1 8/2010 Fitzpatrick et al.
2010/0236394 A1 9/2010 Gomez
2010/0242334 A1 9/2010 Kincel
2010/0269682 A1 10/2010 Vuksanovich et al.
2010/0281734 A1 11/2010 Rousseau et al.
2010/0287808 A1 11/2010 King
2010/0313459 A1 12/2010 Gomez
2010/0319231 A1 12/2010 Stone et al.
2010/0319527 A1 12/2010 Giefing
2011/0005384 A1 1/2011 Lewis et al.
2011/0016762 A1 1/2011 Davies

(56) References Cited

U.S. PATENT DOCUMENTS

| | | | |
|---|---|---|---|
| 2011/0061281 | A1 | 3/2011 | Kapusta et al. |
| 2011/0094373 | A1 | 4/2011 | Cassels |
| 2011/0173863 | A1 | 7/2011 | Ingram |
| 2011/0174148 | A1 | 7/2011 | Sy |
| 2011/0209377 | A1 | 9/2011 | Davies |
| 2011/0247254 | A1 | 10/2011 | Barnes |
| 2012/0000109 | A1 | 1/2012 | Zusman |
| 2012/0030983 | A1 | 2/2012 | Kuczynko et al. |
| 2012/0030987 | A1 | 2/2012 | Lee, III |
| 2012/0042557 | A1 | 2/2012 | Gomez et al. |
| 2012/0073177 | A1 | 3/2012 | Laney et al. |
| 2012/0079752 | A1 | 4/2012 | Peterson et al. |
| 2012/0111183 | A1 | 5/2012 | Hochstrate et al. |
| 2012/0132068 | A1 | 5/2012 | Kucynko |
| 2012/0137556 | A1 | 6/2012 | Laney et al. |
| 2012/0137562 | A1 | 6/2012 | Langevin et al. |
| 2012/0137869 | A1 | 6/2012 | Gomez et al. |
| 2012/0137872 | A1 | 6/2012 | Crommett |
| 2012/0152105 | A1 | 6/2012 | Gomez et al. |
| 2012/0167424 | A1 | 7/2012 | Gomez |
| 2012/0180354 | A1 | 7/2012 | Sullivan et al. |
| 2012/0186123 | A1 | 7/2012 | Troy et al. |
| 2012/0204713 | A1 | 8/2012 | Patel |
| 2012/0222344 | A1 | 9/2012 | Werner |
| 2012/0260793 | A1 | 10/2012 | Gomez |
| 2013/0055613 | A1 | 3/2013 | Gomez et al. |
| 2013/0068089 | A1 | 3/2013 | Brown |
| 2013/0097911 | A1 | 4/2013 | Larue |
| 2013/0152443 | A1 | 6/2013 | Gomez et al. |
| 2013/0174457 | A1 | 7/2013 | Gangl et al. |
| 2013/0192114 | A1 | 8/2013 | Christenson |
| 2013/0205637 | A1 | 8/2013 | Patel |
| 2013/0263732 | A1 | 10/2013 | Kucynko |
| 2013/0269232 | A1 | 10/2013 | Harris et al. |
| 2013/0269510 | A1 | 10/2013 | Sullivan |
| 2014/0026459 | A1 | 1/2014 | Yan et al. |
| 2014/0026744 | A1 | 1/2014 | Gomez et al. |
| 2014/0033590 | A1 | 2/2014 | Gomez |
| 2014/0041518 | A1 | 2/2014 | Neitzling |
| 2014/0060293 | A1 | 3/2014 | Gomez |
| 2014/0060509 | A1 | 3/2014 | Tseng |
| 2014/0068987 | A1 | 3/2014 | Burt |
| 2014/0075817 | A1 | 3/2014 | Gomez |
| 2014/0076144 | A1 | 3/2014 | Gomez |
| 2014/0076146 | A1 | 3/2014 | Gomez |
| 2014/0090283 | A1 | 4/2014 | Gomez |
| 2014/0163664 | A1 | 6/2014 | Goldsmith |
| 2014/0190056 | A1 | 7/2014 | Troy et al. |
| 2014/0230642 | A1 | 8/2014 | Reynolds et al. |
| 2014/0259843 | A1 | 9/2014 | Matteson |
| 2014/0260946 | A1 | 9/2014 | Gomez |
| 2014/0373415 | A1 | 12/2014 | Faifer |
| 2015/0027427 | A1 | 1/2015 | Maeda |
| 2015/0075052 | A1 | 3/2015 | Boyarkin |
| 2015/0260469 | A1 | 9/2015 | Gomez |
| 2015/0323269 | A1 | 11/2015 | McGinty |
| 2015/0330728 | A1 | 11/2015 | McGinty |
| 2015/0345895 | A1 | 12/2015 | Young |
| 2016/0047612 | A1 | 2/2016 | Sullivan et al. |
| 2016/0069636 | A1 | 3/2016 | Gomirato et al. |
| 2016/0116240 | A1 | 4/2016 | Gomez |
| 2016/0116249 | A1 | 4/2016 | Maugham |
| 2016/0305738 | A1 | 10/2016 | Huang et al. |
| 2016/0370135 | A1 | 12/2016 | Plumb et al. |
| 2017/0023328 | A1 | 1/2017 | Irvin et al. |
| 2017/0108303 | A1 | 4/2017 | Gomez |
| 2017/0115078 | A1 | 4/2017 | Plumb |
| 2017/0160027 | A1 | 6/2017 | Gangl |
| 2017/0205190 | A1 | 7/2017 | Jen et al. |
| 2017/0219311 | A1 | 8/2017 | Reavis, III |
| 2017/0241737 | A1 | 8/2017 | Keller, II |
| 2017/0321978 | A1 | 11/2017 | Brannan et al. |
| 2017/0328672 | A1 | 11/2017 | Hewes et al. |
| 2018/0066906 | A1 | 3/2018 | Gomez |
| 2018/0119721 | A1 | 5/2018 | Gomez |
| 2018/0156568 | A1 | 6/2018 | Troy et al. |
| 2019/0017777 | A1 | 1/2019 | Wilson et al. |
| 2019/0063867 | A1 | 2/2019 | Gomez |
| 2019/0195581 | A1 | 6/2019 | Cassels |
| 2019/0293379 | A1 | 9/2019 | Taylor |
| 2020/0018564 | A1 | 1/2020 | Gomez |
| 2020/0096268 | A1 | 3/2020 | Lage |
| 2020/0240726 | A1 | 7/2020 | Spangler et al. |
| 2020/0333095 | A1 | 10/2020 | Gomez |
| 2020/0386508 | A1 | 12/2020 | Gomez |

OTHER PUBLICATIONS

U.S. Appl. No. 16*916,026, filed Jun. 29, 2020, Gomez.
U.S. Appl. No. 17/071,711, filed Oct. 15, 2020, Gomez.
U.S. Appl. No. 17/152,768, filed Jan. 19, 2021, Gomez.
U.S. Appl. No. 61/524,500, filed Aug. 17, 2011, Gomez.
U.S. Appl. No. 62/925,783, filed Jan. 10, 2014, Visinski et al.
U.S. Appl. No. 11/188,734, filed Aug. 10, 2007, Notice of Allowance in the U.S. Patent and Trademark Office.
U.S. Appl. No. 11/491,141, filed Jan. 23, 2008, Office Action in the U.S. Patent and Trademark Office.
U.S. Appl. No. 11/491,141, filed Aug. 13, 2008, Notice of Allowance in the U.S. Patent and Trademark Office.
U.S. Appl. No. 11/825,221, filed Feb. 5, 2010, Office Action in the U.S. Patent and Trademark Office.
U.S. Appl. No. 11/825,221, filed Jun. 18, 2010, Notice of Allowance in the U.S. Patent and Trademark Office.
U.S. Appl. No. 12/217,874, filed Jan. 4, 2011, Office Action in the U.S. Patent and Trademark Office.
U.S. Appl. No. 12/217,874, filed Oct. 12, 2011, Notice of Allowance in the U.S. Patent and Trademark Office.
U.S. Appl. No. 12/217,874, filed Oct. 12, 2011, Requirement for Restriction/Election in the U.S. Patent and Trademark Office.
U.S. Appl. No. 12/217,874, filed Nov. 15, 2011, Notice of Allowance in the U.S. Patent and Trademark Office.
U.S. Appl. No. 12/316,241, filed Feb. 7, 2011, Office Action in the U.S. Patent and Trademark Office.
U.S. Appl. No. 12/316,241, filed Oct. 12, 2011, Final Office Action in the U.S. Patent and Trademark Office.
U.S. Appl. No. 12/316,241, filed May 1, 2012, Office Action in the U.S. Patent and Trademark Office.
U.S. Appl. No. 12/316,241, filed Sep. 27, 2012, Requirement for Restriction/Election in the U.S. Patent and Trademark Office.
U.S. Appl. No. 12/316,241, filed Oct. 12, 2012, Notice of Allowance in the U.S. Patent and Trademark Office.
U.S. Appl. No. 12/381,240, filed Feb. 15, 2011 Office Action in the U.S. Patent and Trademark Office.
U.S. Appl. No. 12/381,240, filed Sep. 14, 2011, Final Office Action in the U.S. Patent and Trademark Office.
U.S. Appl. No. 12/801,001, filed Feb. 15, 2012, Requirement for Restriction/Election in the U.S. Patent and Trademark Office.
U.S. Appl. No. 12/801,001, filed Nov. 19, 2012, Notice of Allowance in the U.S. Patent and Trademark Office.
U.S. Appl. No. 13/419,202, filed Aug. 30, 2012, Notice of Allowance in the U.S. Patent and Trademark Office.
U.S. Appl. No. 13/430,281, filed Dec. 5, 2012, Office Action in the U.S. Patent and Trademark Office.
U.S. Appl. No. 13/430,281, filed Apr. 17, 2013, Notice of Allowance in the U.S. Patent and Trademark Office.
U.S. Appl. No. 13/430,281, filed Nov. 5, 2013, Notice of Allowance in the U.S. Patent and Trademark Office.
U.S. Appl. No. 13/562,651, filed Jun. 10, 2014, Requirement for Restriction/Election in the U.S. Patent and Trademark Office.
U.S. Appl. No. 13/562,651, filed Aug. 26, 2014, Office Action in the U.S. Patent and Trademark Office.
U.S. Appl. No. 13/562,651, filed Jul. 9, 2015, Final Office Action in the U.S. Patent and Trademark Office.
U.S. Appl. No. 13/562,663, filed Sep. 25, 2014, Office Action in the U.S. Patent and Trademark Office.
U.S. Appl. No. 13/562,663, filed Mar. 12, 2015, Notice of Allowance in the U.S. Patent and Trademark Office.

(56) References Cited

OTHER PUBLICATIONS

U.S. Appl. No. 13/588,294, filed Mar. 28, 2014, Requirement for Restriction/Election in the U.S. Patent and Trademark Office.
U.S. Appl. No. 13/588,294, filed Sep. 24, 2014, Notice of Allowance in the U.S. Patent and Trademark Office.
U.S. Appl. No. 13/738,894, filed May 7, 2014, Requirement for Restriction/Election in the U.S. Patent and Trademark Office.
U.S. Appl. No. 13/738,894, filed Dec. 3, 2014, Office Action in the U.S. Patent and Trademark Office.
U.S. Appl. No. 13/738,894, filed Dec. 15, 2015, Office Action in the U.S. Patent and Trademark Office.
U.S. Appl. No. 13/738,894, filed Aug. 3, 2016, Notice of Allowance in the U.S. Patent and Trademark Office.
U.S. Appl. No. 13/756,320, filed Jul. 12, 2013, Requirement for Restriction/Election in the U.S. Patent and Trademark Office.
U.S. Appl. No. 13/756,320, filed Sep. 11, 2013, Office Action in the U.S. Patent and Trademark Office.
U.S. Appl. No. 13/756,320, filed Jan. 27, 2014, Notice of Allowance in the U.S. Patent and Trademark Office.
U.S. Appl. No. 13/769,224, filed Aug. 9, 2013, Requirement for Restriction/Election in the U.S. Patent and Trademark Office.
U.S. Appl. No. 13/769,224, filed Nov. 29, 2013, Office Action in the U.S. Patent and Trademark Office.
U.S. Appl. No. 13/769,224, filed Mar. 18, 2014, Notice of Allowance in the U.S. Patent and Trademark Office.
U.S. Appl. No. 13/837,697, filed Jul. 16, 2014, Requirement for Restriction/Election in the U.S. Patent and Trademark Office.
U.S. Appl. No. 13/837,697, filed Sep. 30, 2014, Notice of Allowance in the U.S. Patent and Trademark Office.
U.S. Appl. No. 13/841,618, filed May 27, 2014, Notice of Allowance in the U.S. Patent and Trademark Office.
U.S. Appl. No. 14/470,513, filed Feb. 4, 2016, Requirement for Restriction/Election in the U.S. Patent and Trademark Office.
U.S. Appl. No. 14/470,513, filed Jun. 30, 2016, Office Action in the U.S. Patent and Trademark Office.
U.S. Appl. No. 14/575,923, filed Jul. 9, 2017, Notice of Allowance in the U.S. Patent and Trademark Office.
U.S. Appl. No. 14/575,923, filed Jan. 15, 2016, Office Action in the U.S. Patent and Trademark Office.
U.S. Appl. No. 14/575,923, filed May 6, 2016, Final Office Action in the U.S. Patent and Trademark Office.
U.S. Appl. No. 14/575,923, filed Jan. 12, 2017, Final Office Action in the U.S. Patent and Trademark Office.
U.S. Appl. No. 14/577,503, filed Jun. 10, 2015, Requirement for Restriction/Election in the U.S. Patent and Trademark Office.
U.S. Appl. No. 14/577,503, filed Aug. 28, 2015, Office Action in the U.S. Patent and Trademark Office.
U.S. Appl. No. 14/577,503, filed Nov. 12, 2015, Notice of Allowance in the U.S. Patent and Trademark Office.
U.S. Appl. No. 14/593,513, filed Aug. 13, 2015, Office Action in the U.S. Patent and Trademark Office.
U.S. Appl. No. 14/593,513, filed Jan. 14, 2016, Final Office Action in the U.S. Patent and Trademark Office.
U.S. Appl. No. 14/844,886, filed Feb. 29, 2016, Office Action in the U.S. Patent and Trademark Office.
U.S. Appl. No. 15/058,488, filed Dec. 9, 2016, Notice of Allowance in the U.S. Patent and Trademark Office.
U.S. Appl. No. 15/332,143, filed Nov. 15, 2017, Requirement for Restriction/Election in the U.S. Patent and Trademark Office.
U.S. Appl. No. 15/332,143, filed Aug. 27, 2018, Office Action in the U.S. Patent and Trademark Office.
U.S. Appl. No. 15/332,143, filed Jun. 13, 2019, Final Office Action in the U.S. Patent and Trademark Office.
U.S. Appl. No. 15/332,143, filed Feb. 21, 2020, Notice of Allowance in the U.S. Patent and Trademark Office.
U.S. Appl. No. 15/471,808, filed Nov. 1, 2017, Notice of Allowance in the U.S. Patent and Trademark Office.
U.S. Appl. No. 15/589,708, filed Jan. 10, 2018, Office Action in the U.S. Patent and Trademark Office.
U.S. Appl. No. 15/589,708, filed Nov. 15, 2018, Notice of Allowance in the U.S. Patent and Trademark Office.
U.S. Appl. No. 15/596,834, filed May 17, 2018, Office Action in the U.S. Patent and Trademark Office.
U.S. Appl. No. 15/596,834, filed Jan. 23, 2019, Notice of Allowance in the U.S. Patent and Trademark Office.
U.S. Appl. No. 15/806,137, filed Nov. 1, 2018 Requirement for Restriction/Election in the U.S. Patent and Trademark Office.
U.S. Appl. No. 15/806,137, filed May 31, 2019, Office Action in the U.S. Patent and Trademark Office.
U.S. Appl. No. 15/806,137, filed Dec. 31, 2019, Notice of Allowance in the U.S. Patent and Trademark Office.
U.S. Appl. No. 15/811,404, filed Jan. 11, 2019, Requirement for Restriction/Election in the U.S. Patent and Trademark Office.
U.S. Appl. No. 15/811,404, filed Nov. 13, 2019, Office Action in the U.S. Patent and Trademark Office.
U.S. Appl. No. 15/811404, filed Jun. 24, 2020, Notice of Allowance in the U.S. Patent and Trademark Office.
U.S. Appl. No. 15/918,935, filed Jan. 7, 2019, Requirement for Restriction/Election in the U.S. Patent and Trademark Office.
U.S. Appl. No. 15/918,935, filed Jul. 23, 2019, Office Action in the U.S. Patent and Trademark Office.
U.S. Appl. No. 15/918,935, filed Nov. 6, 2019, Notice of Allowance in the U.S. Patent and Trademark Office.
U.S. Appl. No. 16/277,506, filed Oct. 25, 2019, Office Action in the U.S. Patent and Trademark Office.
U.S. Appl. No. 16/277,506, filed Sep. 21, 2020, Notice of Allowance in the U.S. Patent and Trademark Office.
U.S. Appl. No. 29/371,221, filed Mar. 15, 2011, Office Action in the U.S. Patent and Trademark Office.
U.S. Appl. No. 29/371,221, filed May 31, 2011, Notice of Allowance in the U.S. Patent and Trademark Office.
U.S. Appl. No. 29/439,542, filed Jan. 30, 2014, Ex Parte Quayle Action in the U.S. Patent and Trademark Office.
U.S. Appl. No. 29/439,542, filed Sep. 23, 2014, Final Office Action in the U.S. Patent and Trademark Office.
U.S. Appl. No. 29/439,542, filed Apr. 9, 2015, Notice of Allowance in the U.S. Patent and Trademark Office.
U.S. Appl. No. 29/449,534, filed Apr. 25, 2014, Notice of Allowance in the U.S. Patent and Trademark Office.
12" LWRC REPR SBR, [online], [2011]. Retrieved from the Internet: <URL: http://forum.lwrci.com/viewtopic.php?f=35&t=10081.
Brownells, Inc., "Brownells—Barrel Extension Torque Tool," YouTube video [online], published Oct. 6, 2011, [retrieved on Aug. 9, 2018]. Retrieved from the Internet: <URL: www.youtube.com/watch?v=n4Y_JrfDcXU>.
Charlie Cutshaw, "Fal Fever!" Combat Tactics, www.surefire.com; Fall 2005; 14 pages.
David Crane, "LMT MRP Piston/Op-Rod System v. HK416: 2,000-Round Head-to-Head Test," Defense Review (www.defensereview.com); Feb. 23, 2009 (5 web pages), plus 6 enlarged photographs from the web pages. [Reprint of text retrieved Nov. 12, 2015, online], Retrieved from the Internet: <URL: http://www.defensereview.com/lmt-mrp-pistonop-rod-system-vs-hk416-2000-round-head-to-head-test/>.
Iannamico, "The U.S. Ordnance Department Tests The German FG-42," Journal Article: The Small Arms Review, 2007: vol. 10(9), pp. 83-88.
International Search Report for PCT/US07/16133 dated Nov. 6, 2008.
LWRC REPR 7.62mm Photo Gallery, [online], [retrieved on Nov. 5, 2009]. Retrieved from the Internet: <URL: http://www.xdtalk.com/forums/ar-talk/135060-lwrc-repr-7-62mm-photo-gallery.html.
Rob Curtis, "AAC's MPW "Honey Badger" don't care . . . ;" Military Times GearScout (http://blogs.militarytimes.com/gearscout/2011/10/15/aacs-mpw-h-oney-badger-dont-care/); Oct. 15, 2011 [Retrieved on May 17, 2013] (2 web pages), plus 4 enlarged photographs from the web pages.
Rob Curtis, Reaction Rod by Geissele Automatics, Military Times—Gear Scout, Oct. 12, 2012; , [online], [retrieved on Nov. 12, 2015]. Retrieved from the Internet: <URL: http://gearscout.militarytimes.com/2012/10/12/reaction-rod-by-geissele-automatics/>.

(56) References Cited

OTHER PUBLICATIONS

The Brownells Critical Tool Kit Website, "Brownells—AR-15/M16 Critical Tools Kit," [online], [retrieved on Aug. 10, 2018]. Retrieved from the Internet: <URL: http://investors.maxwell.com/phoenix.zhtml?c=94560&p=irol-newsArticle&ID=1903210 URL: <www.brownells.com/gunsmith-tools-supplies/general-gunsmith-tools/gunsmithing-tool-kits/ar-15-m16-critical-tools-kit-prod41214.aspx>.
U.S. Appl. No. 16/430,865, filed Sep. 17, 2020, Office Action in the U.S. Patent and Trademark Office.
U.S. Appl. No. 16/430,865, filed Apr. 1, 2021, Notice of Allowance in the U.S. Patent and Trademark Office.

* cited by examiner

BARREL NUT ASSEMBLY

PRIOR ART

PRIOR ART

BARREL NUT ASSEMBLY AND METHOD TO ATTACH A BARREL TO A FIREARM USING SUCH ASSEMBLY

CROSS-REFERENCE TO RELATED APPLICATIONS

This application is a divisional of U.S. patent application Ser. No. 15/332,143, filed Oct. 24, 2016, which is a continuation of U.S. patent application Ser. No. 13/738,894, filed Jan. 10, 2013, now granted as U.S. Pat. No. 9,506,711, which is a continuation-in-part of U.S. patent application Ser. No. 13/562,651, filed Jul. 31, 2012, now granted as U.S. Pat. No. 9,816,546. The contents of each is incorporated herein in their entirety.

BACKGROUND OF THE INVENTION

1. Field of Invention

The invention relates in general, to firearms, and more particularly to fixtures which mitigate the transfer of torque from the barrel nut to the firearms receiver during installation of the barrel.

2. Description of the Related Art

Firearms in the M16 family, which include but are not limited to, the AR1O, SR25, AR15, and piston driven systems and other similar designs, have been in use with military, police, and civilian shooters for nearly 50 years. The M16 family of firearms includes a lower receiver having a stock coupled to the rear end which is connected to an upper receiver having a barrel coupled to the front end. The chamber end of the barrel is received by a portion of the upper receiver and threadedly secured in place. The threads of the upper receiver which receive the barrel nut are not timed in any way but require a minimum torque of 30 foot pounds to secure the barrel in place. The outer surface of the barrel nut has a series of spokes, with gaps formed between, which are used to apply torque to the barrel nut. In order to properly install the gas operating system of the firearm, a gap in the spokes must be in alignment with an opening in the front of the upper receiver. This alignment is required because the gap between the spokes facilitates the entry of either a piston or a gas tube, of the gas operating system, into the interior of the upper receiver. To achieve this required alignment, the barrel nut is often either under-or over-torqued. Both of these conditions present a variety of potential problems which include, but are not limited to, damage to the firearm, poor accuracy during normal operation or compromised operational reliability.

Indirect gas operated M16 type rifles, often referred to as piston driven, such as the design described in U.S. Pat. No. 7,461,581 ("the '581 patent"), are becoming increasingly popular within both the commercial and military markets due to the increased operational reliability offered by such systems. The vast majority of these new piston driven designs rely on the prior art barrel nut common to the M16 family of firearms and as such have inherited the flaws of this design. In addition to the trouble which can result from improper torque being applied to the barrel nut, these piston designs depend on a moving piston, which is supported by the spokes of the barrel nut, to operate. However, the spokes of the barrel nut were not designed for this purpose and, as a result, present a weak point in the operational reliability of these new piston driven designs. Over time some systems which rely on the prior art barrel nut fail because the spokes which support the piston directly, or a removable bushing which houses the piston, start to bend or break, rendering the firearm inoperable. Therefore a need exists for a barrel nut design that will remedy the foregoing and other deficiencies inherent in the prior art.

Installation of the legacy AR15/M16 barrel nut, even when done properly, results in the transfer of torque from the barrel nut to the firearms receiver during installation of the barrel. This is of particular concern when the receiver alone is being restrained by a fixture that is secured in place by vice. Torque is transferred to the receiver when so restrained because the annular flange of the barrel is resting against the forward face of the receivers threaded extension while the barrel nut is threadedly secured in place, More specifically, when the barrel is being secured in place, the barrel nut is rotated thereby depressing the annular flange of the barrel against the forward face of the receivers threaded extension. While the barrel nut is being rotated, the rotation force (torque) is transferred to the annular flange of the barrel. The rotation of the barrel, vicarious of the annular flange, is arrested by the receivers threaded extension. By preventing the rotation of the barrel, the receiver is absorbing a portion of the torque being applied to the barrel nut. This can result in the warping or cracking of the receiver and its threaded extension.

Damage resulting from this transfer of torque to the receiver may be mitigated or even eliminated when a proper predetermined torque value is applied to the barrel nut during the installation of the barrel. But, as discussed above, over torquing the barrel nut is often required in order to facilitate the proper alignment of a gap between the flanges of the prior art barrel nut with the gas tube opening on the face of the upper receiver. While the prior art barrel nut may be installed within the given range of 30 ft-lb to 80 ft-lb of torque, it is a common belief that torque applied at and near the upper end of this range is detrimental to the accuracy of the firearm in many cases. This degradation of accuracy is attributed to the receiver warping as a result of the barrel nuts installation. In order to minimize this transfer of torque from the barrel nut to the receiver, some gun smiths use vise blocks of differing designs to secure the barrels itself within a vice thereby preventing the receiver from resisting the rotation of the barrel during the installation of the barrel nut.

Prior art vise blocks have several deficiencies which become apparent during use. It is very difficult to secure a barrel within vice blocks with sufficient force so as to prevent its unintentional rotation during assembly, while at the same time not damaging the external finish of the firearm. It is also very difficult to predict how much force the user needs to apply to the vice in order to properly secure the barrel and thus prevent rotation without a period of trial and error. During this period of trial and error, the barrel will slip and rotate within the fixture when torque is applied to the barrel nut. Further, the use of vice blocks that secure about the barrel also requires that the gas tube or gas piston need to be removed in order to install a muzzle device. The removal of the gas system may be incidental and of little concern for work on a single rifle, but becomes very inefficient when work is being performed on an industrial scale. Thus a need exists for a fixture which aids in the installation of a barrel onto a receiver, that will remedy the foregoing and other deficiencies inherent in the prior art.

SUMMARY OF THE INVENTION

Accordingly several objects and advantages of the present invention are:

(a) To overcome the disadvantages associated with the conventional barrel nut which can be under- or over-torqued in order to better accommodate the gas operating system;

(b) To provide a barrel nut assembly with an integral bushing to support a piston or to guide the gas tube of a gas operated firearm;

(c) To provide a barrel nut which is oriented about the barrel and receiver independently of the torque which is applied to secure the barrel in place; and (d) To provide a fixture which minimizes, or eliminates, the transfer of torque to the receiver of a firearm resulting from the use of a barrel nut, or barrel nut assembly, during the installation of a barrel.

In accordance with one embodiment of the present invention, a barrel nut assembly including a barrel nut and a locknut for coupling a barrel to the receiver of a firearm are provided. The barrel nut has internal threads and an external flange which is designed to be held in a fixture that is secured in a vice during barrel installation. The barrel nut body is designed to receive the threaded extension of the upper receiver in its back side and the chamber end of the barrel in its front side. An annular locknut, which has a central opening to receive the barrel, is used to secure the barrel to the host firearm's receiver. A preset torque value is applied to secure the locknut, and thereby the barrel, into place. While the locknut is being rotated, the barrel nut and upper receiver are held securely in a fixture which prevents the unintentional rotation and resulting misalignment of the barrel nut in relationship to the upper receiver. Further, the locknut places torque directly against a portion of the barrel, effectively compressing it against the front part of the upper receiver. The barrel nut assembly design and method of installation according to the present invention eliminate the problems inherent in the prior art as a result of applying an inappropriate torque value to a barrel nut in an effort to align the barrel nut with the gas tube of the firearm's operating system during barrel installation.

The body of the barrel nut also includes an integral bushing which is designed to receive and support a portion of a gas piston or gas tube of the firearm's operating system. Having a bore designed to be aligned with an opening present on the forward face of the upper receiver through which the operating rod passes, the integral bushing is structurally sound and will not bend or deform even after prolonged use of the host firearm. Accordingly the present invention provides a barrel nut assembly that affords the user with a method and apparatus for aligning the bushing bore with the upper receiver opening that is independent of the torque required to properly secure the barrel to the upper receiver.

Two fixtures for the use with the barrel nut assembly described herein are disclosed. One of the fixtures works by being secured about a portion of the firearms receiver and barrel nut, thereby holding them in proper alignment with each other during the installation of the barrel and locknut as discussed above. When the provided locknut is being used to secure the barrel to the receiver of the firearm, the barrel nut, and the selected torque value significantly mitigate the transfer of torque to the receiver of the firearm. A second fixture provided for herein is directed to the elimination of torque being transferred to the firearms receiver during the installation of the barrel nut. This fixture includes a mandrel which is received within the interior opening of the firearm receiver to engage with the lugs of the barrel extension and thereby rotational restrain the barrel. Additionally, this fixture provides a member which receives and rotationally restrains the barrel nut and provides for a clamp which assists in securing the receiver to the fixture.

Still further objects and advantages will become apparent from a consideration of the ensuing description and drawings where like reference numerals refer to corresponding elements throughout.

DESCRIPTION OF THE DRAWINGS

The characteristic features of the invention, together with further advantages thereof, will be better understood from the following description considered in connection with the accompanying drawings in which a preferred embodiment of the present invention is illustrated by way of example. It is to be expressly understood, however, that the drawings are for the purpose of illustration and description only and are not intended to define the limits of the invention.

DETAILED DESCRIPTION OF THE PREFERRED EMBODIMENT

The present invention is directed to a barrel nut assembly for use with the AR-10, AR-15, SR25, M16 firearms and other derivatives to include those which use a gas piston in place of a conventional gas tube. Unless otherwise specified, the various components which make up the trigger mechanism, upper receiver assembly, lower receiver assembly, buttstock assembly, bolt assembly and barrel assembly are those found on the prior art M16 and M4 rifles and their various embodiments.

Figure 1:
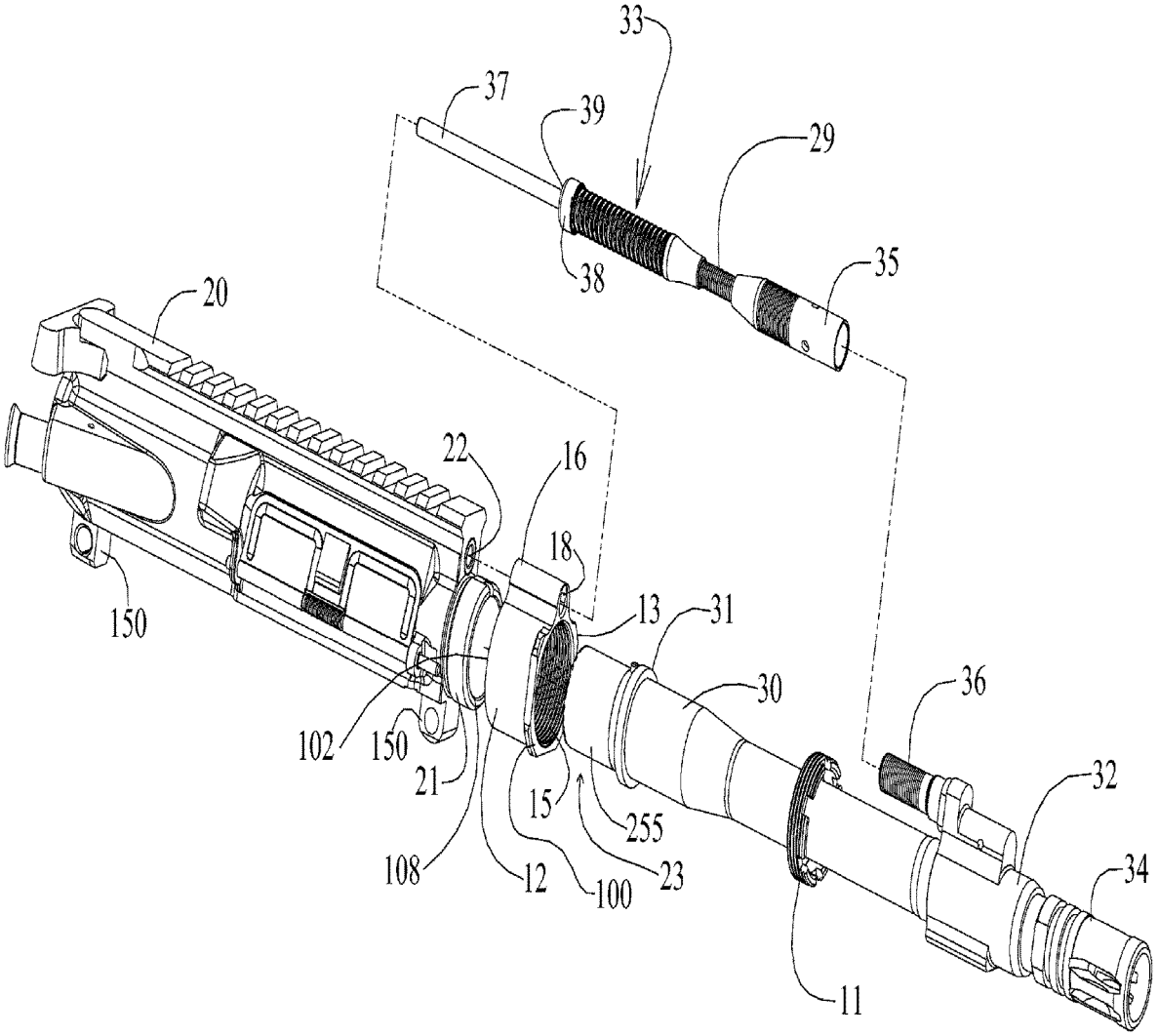
FIG. 1 is an exploded perspective view of an upper receiver with a barrel being secured with a barrel nut assembly in accordance with the present invention.

As used herein, the word "front" or "forward" corresponds to the end nearest the barrel (i.e., to the right as shown in FIG. 1); and "rear" or "rearward" or "back" corresponds to the direction opposite the end of the barrel, where the receiver is located (i.e., to the left as shown in FIG. 1).

The present invention is directed to a barrel nut assembly for securing a barrel to the front end of a receiver. In FIG. 1 there is illustrated an exploded perspective view of a firearm upper receiver group. Shown is the receiver 20 which has an opening 22 on its forward face and a threaded extension 21. The threaded extension 21 is configured to threadedly receive the rearward end of the barrel nut 12. The barrel 30 for the host firearm is shown with a flash hider 34 and gas block 32 installed at its forward end. The construction of the barrel 30 is of a conventional M16 type. The rearward or chamber end 23 of the barrel 30 has an annular flange 31.

The piston assembly, generally designated by reference numeral 33, incorporates a piston cup 35 at its forward end, an operating rod 37 at the back end and a connecting rod 29 located therebetween. The gas block 32 incorporates a gas nozzle 36 which is received by the piston cup 35. The piston assembly 33 and the gas nozzle 36 are components of the operating system being used with the preferred embodiment. The specific components and features which make up the piston assembly 33 and the gas nozzle 32, along with the methods of their installation, are described in the '581 patent and co-pending, commonly owned, patent application U.S. Ser. No. 12/801,001, which are expressly incorporated by reference as if fully set forth herein. Any manner in which the piston assembly 33 and the gas nozzle 36 differ from '581 patent will be disclosed herein.

Figure 2:
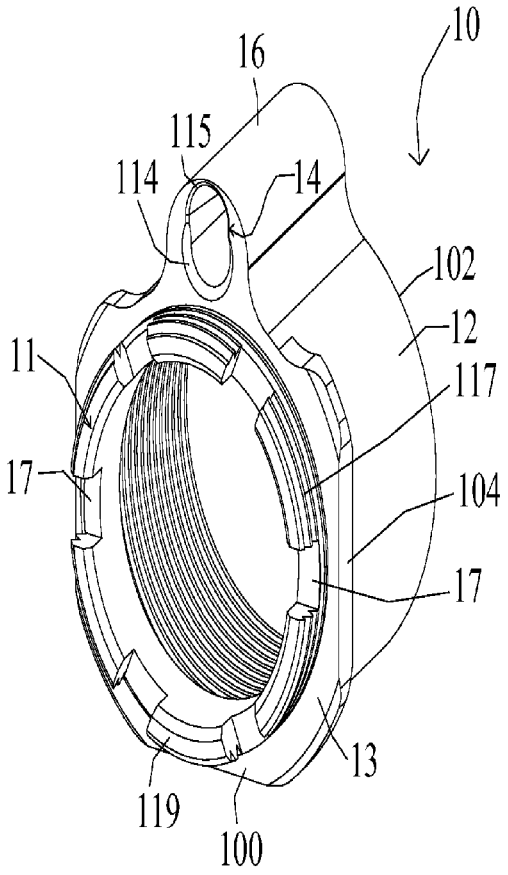
FIG. 2 is an illustration of a barrel nut assembly in accordance with the present invention.

As shown in isolation in FIG. 2, the barrel nut assembly, generally designated by reference number 10, includes the barrel nut 12, and a locknut generally designated by reference numeral 11. The barrel nut 12 has a threaded longitudinal bore 15 that extends from a front end 100 of the barrel nut to the rear end 102 thereof. As shown in FIG. 1, the front end 100 of the barrel nut 12 receives the rear or chamber end of a barrel 30, while the rear end 102 of the barrel nut is threadedly secured to the front extension 21 of the receiver 20.

Figure 3:
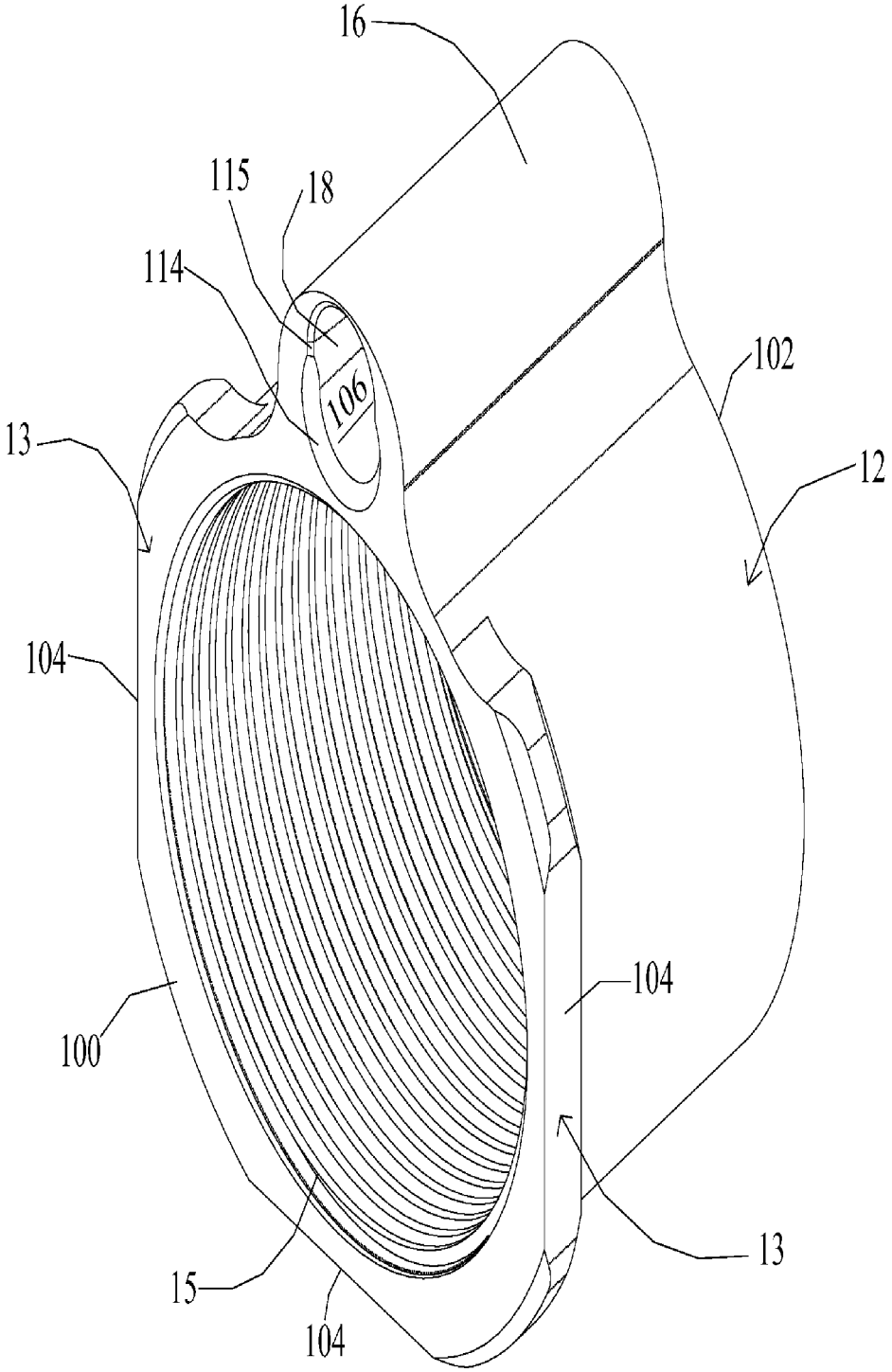
FIG. 3 is a front end perspective view of the barrel nut of the barrel nut assembly shown in FIG. 2.

The barrel nut 12, shown best in FIG. 3, also incorporates an integral bushing 16 mounted longitudinally along the top surface of its exterior. The bushing 16 has a through bore 18 that is generally parallel with the longitudinal bore 15 and defines an inner wall 106 through which the operating rod 37 of the firearm passes during normal operation of the host firearm. The bushing 16 provides a robust support structure for the operating rod 37 and other components of the gas operating system of the host firearm.

Figure 3A:
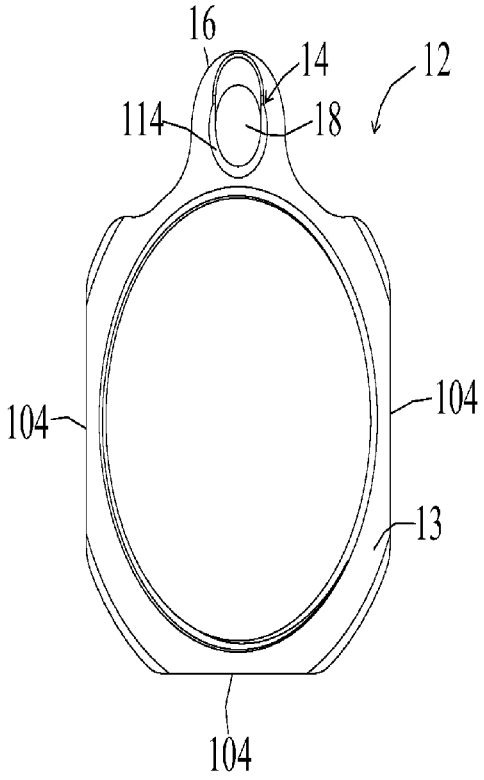
FIG. 3A is a front end view of the barrel nut shown in FIG. 1.

The forward end 100 of the barrel nut includes an exterior flange 13, best shown in FIG. 3A, having at least two and preferably three squared off sections 104 spaced 90° apart to render the forward face of the barrel nut essentially square. These squared off sections 104 are configured to be received within and captured by a fixture (see FIGS. 7A and 7B) used to lock the receiver and barrel nut in place to prevent rotation thereof when mounting the barrel, as will be described hereinafter.

The opening edge 14 about at least the bottom portion 114 of the entrance into the through bore 18 of the bushing 16 is chamfered. In the illustrated embodiment, the opening edge is chamfered all the way around, with the chamfered bottom portion 114 of the edge 14 of the through bore 18 being more substantial than the chamfer extending about the top portion 115 of the through bore 18. This opening edge 14 is configured to receive and support the chamfered rear end 39 of spring cup 38 during and upon installation of the piston assembly 33 shown in FIG. 5. The chamfering of the edge 14 provides "wiggle room" which aids in the installation of the piston assembly. It should also be understood that the opening edge 14 about the face of the through bore 18 can support or be modified to support, spring cup equivalents or the springs of other piston-operated firearms. In general, the opening edge 14 of the through bore 18 of the barrel nut bushing 16 is designed to provide a robust structure to support the spring cup 38 or return spring of a piston driven firearm and provide a surface for it to press against during operation.

Figure 4:
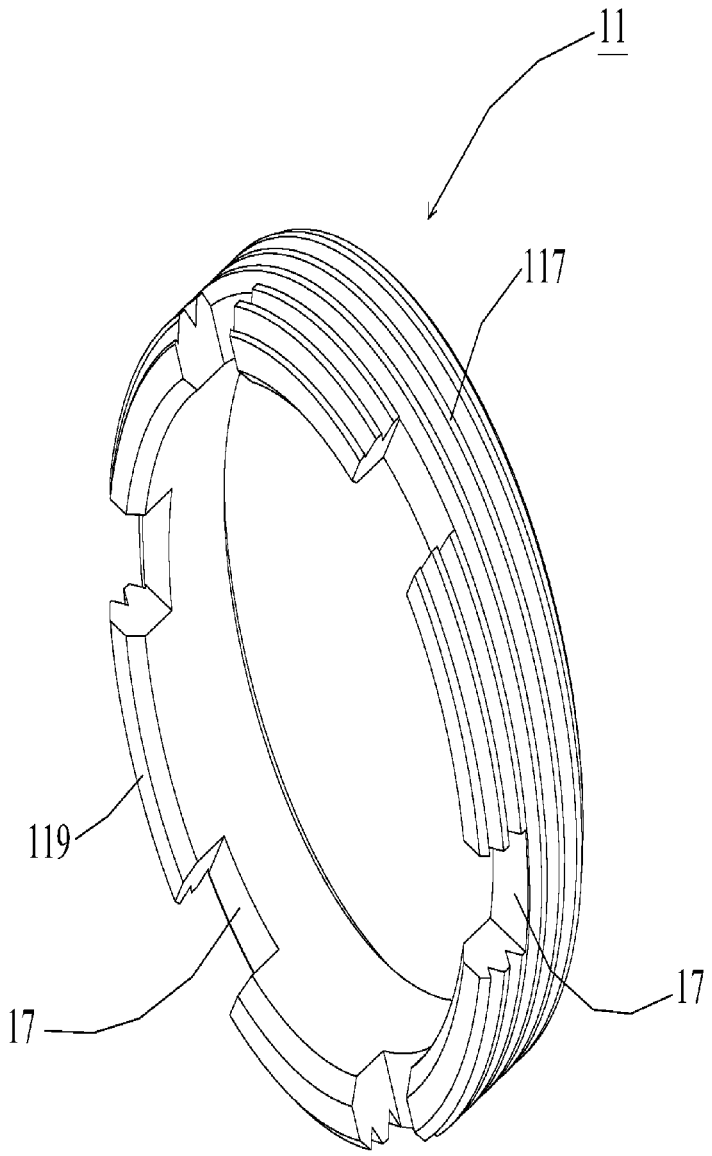
FIG. 4 is a front end perspective view of the locknut of the barrel nut assembly shown in FIG. 2.

FIG. 4 shows an isolated front end perspective view of the locknut 11 of the barrel nut assembly. The locknut has threads 117 about its exterior that are configured to enable the locknut to be threadedly received into the threaded bore 15 of the barrel nut 12 during assembly. The locknut includes a grippable structure preferably embodied as a plurality of cutouts or grooves 17 spaced evenly about the forward face 119 of the locknut 11. These grooves 17 are configured to engage with a complementary gripping structure on a wrench 40 (shown in FIG. 6) which is used to apply torque to the locknut 11 during assembly. The locknut 11 secures the barrel 30 to the barrel nut 12 and to the upper receiver. Because torque is applied to the locknut while the barrel nut is held stationary in the fixture, the barrel nut assembly in accordance with the present invention allows for consistent torque to be used when securing the barrel 30 in place.

Figure 5:
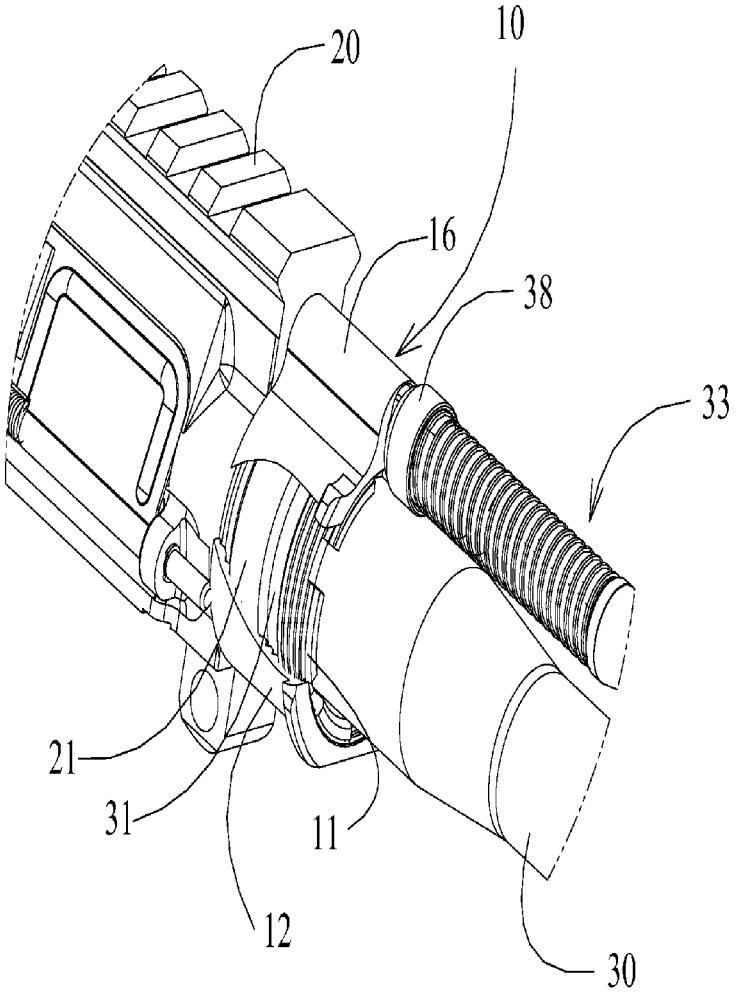
FIG. 5 is a detailed side cutaway view showing the barrel nut assembly according to the present invention in use.

FIG. 5 shows a side cutaway view of upper receiver 20 with barrel 30 being retained by the barrel nut 12 and lock nut 11 of the barrel nut assembly 10 according to the present invention. After threading the barrel nut 12 onto the threaded extension 21 of the receiver 20, the rearward end of the barrel 30 is inserted into the threaded bore 15 of the barrel nut 12. When mounted, the back side of the annular flange 31 of the barrel 30 is aligned with and seated against the forward face 108 of the receiver's threaded extension 21. The locknut 11 is threaded into the threaded bore 15 of the barrel nut and comes to rest against the front side of annular flange 31 when tightened, thereby retaining the barrel 30 and barrel nut 12 in place.

Figure 6:
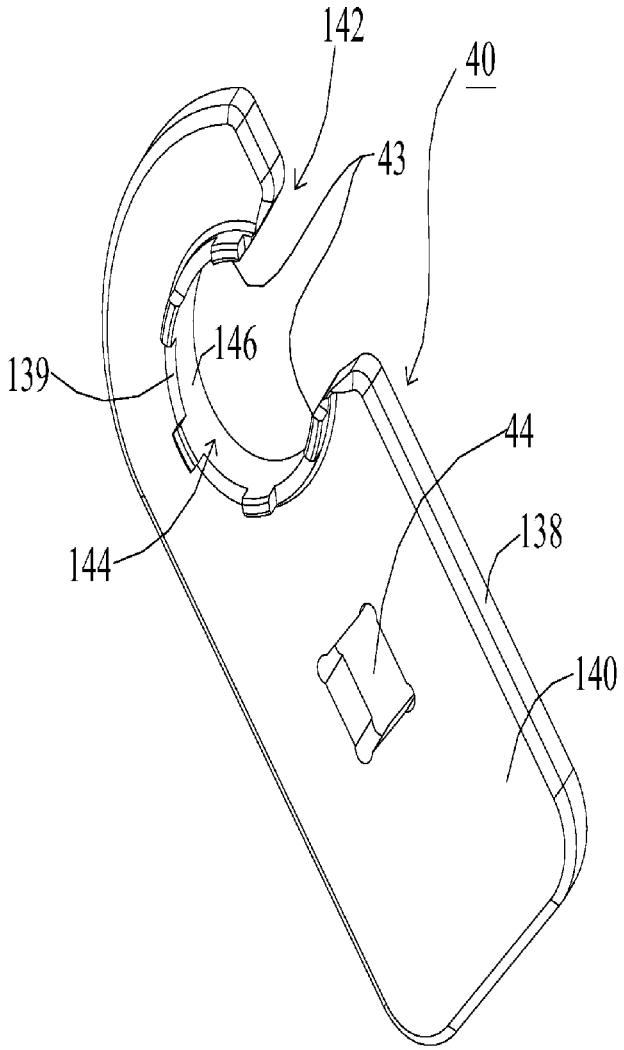
FIG. 6 is a perspective view of a specialized wrench used to secure the locknut against the annular flange on the barrel when securing the barrel to the upper receiver, as shown in FIG. 1, using the barrel nut assembly as shown in FIG. 2.

A specially designed wrench, generally designated by reference numeral 40, is used to secure the lock nut 11 to the barrel nut 12 as shown in FIG. 6. The wrench 40 has a body 138 with a crescent shaped head, generally designated by reference numeral 142, defining a C-shaped opening 144 with an inner periphery 146 about one end. The inner periphery includes a gripping structure embodied as a plurality of teeth 43 which project outwardly from the forward edge 139 of the inner periphery. The teeth 43 are generally perpendicular to the face 140 of one side of the wrench and are configured to engage with the grooves 17 on the front face of the lock nut 11 (see FIGS. 4 and 7A). The body 138 has an aperture 44 therein which is configured to receive the ½" drive member of any conventional socket or torque wrench. It is to be expressly understood that the aperture 44 which receives the drive member of the wrench could be constructed to receive any size or type of drive mechanism found on a wrench.

Figure 7A:
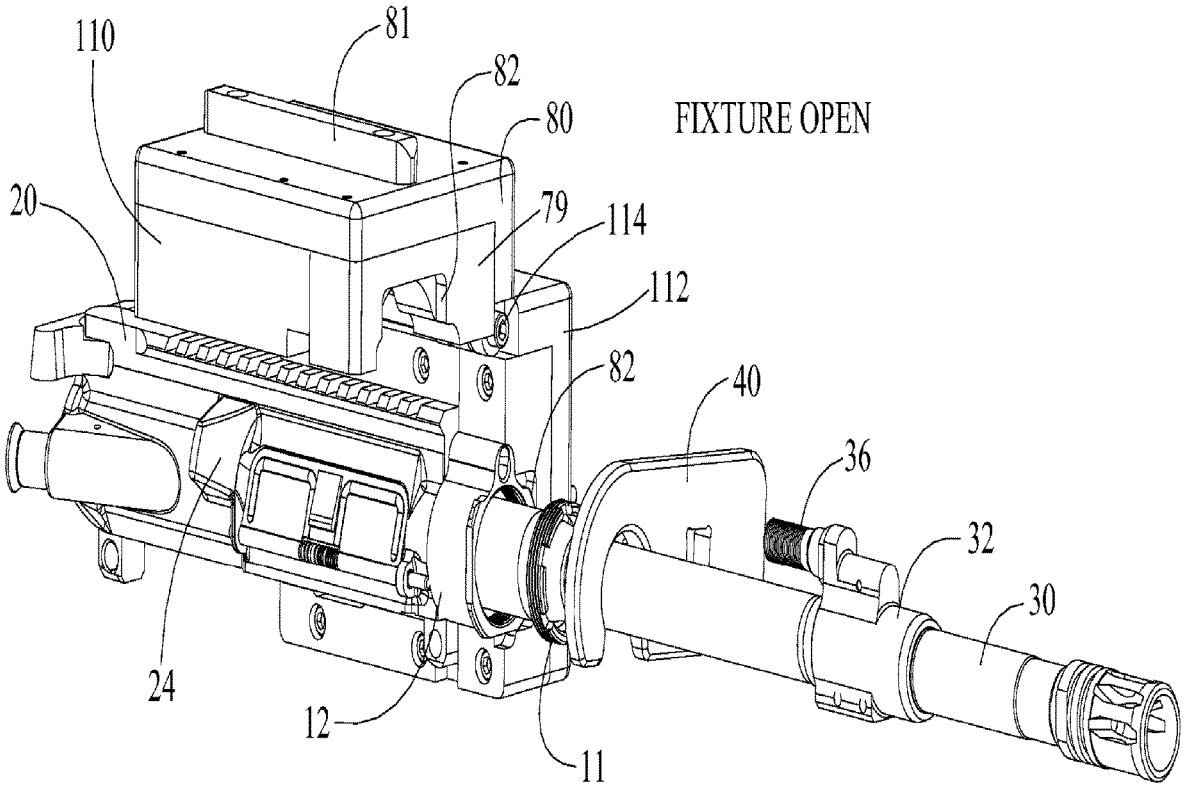
FIGS. 7A and 7B show side perspective views of a rifle equipped with the barrel nut of the present invention secured in a fixture, during installation of the lock nut, the fixture shown in the opened position in FIG. 7A and in the closed position in FIG. 7B.
Figure 7B:
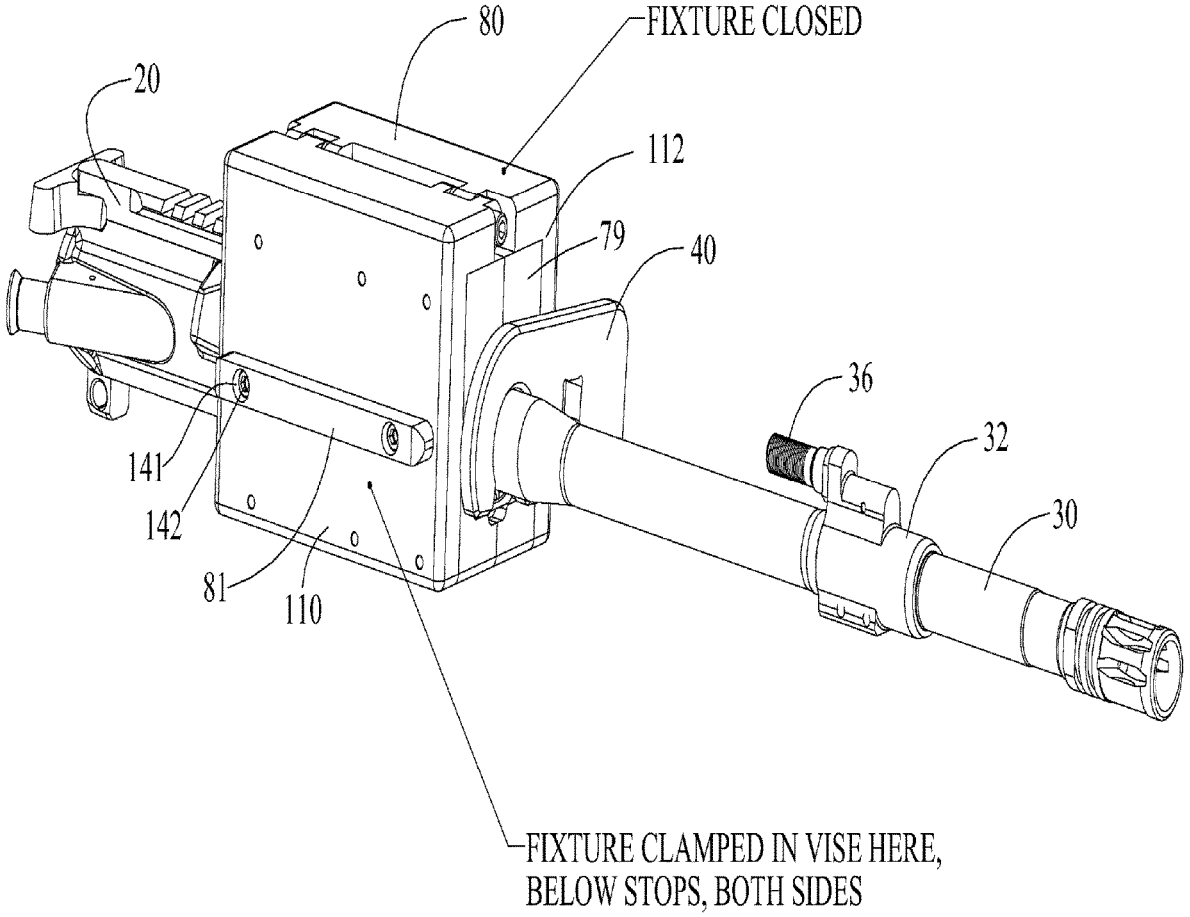
Figure 13A:
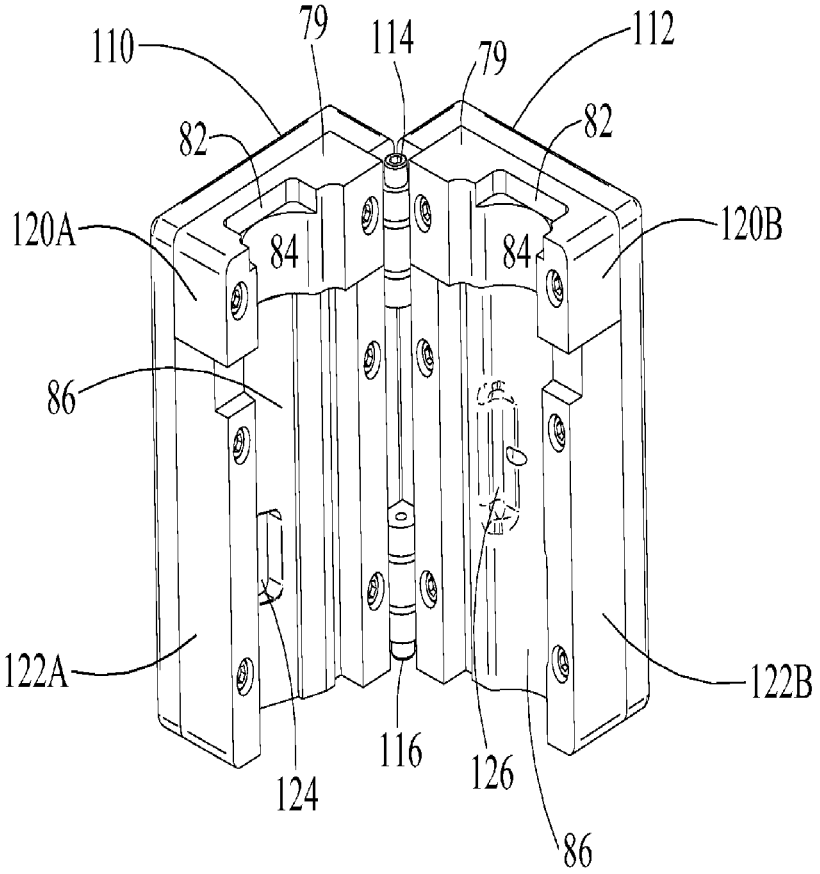
FIGS. 13A and 13B show perspective views of the fixture from FIG. 12 in its opened position.

FIGS. 7A and 7B show a fixture 80 which, in a preferred embodiment, has two halves 110 and 112 interconnected by pivot rods 114 and 116 (shown in FIG. 13A). FIG. 7A shows the fixture 80 in its open position to receive the upper receiver 20 of the firearm with a barrel nut 12 threaded into place. The interior of the fixture 80 is configured to receive and rotationally restrain the upper receiver 20 and the forward face 79 has a cutout 82 to rotationally restrain the barrel nut 12.

In particular, the fixture 80, which is shown in the opened position in FIG. 7A, has a cutout 82 about its forward face 79. The cutout 82 has two opposed sides and a bottom which form three sides of a square. The top or fourth side is recessed in order to accommodate the bushing 16. When the receiver and the barrel nut are positioned in the fixture, the three squared off sections 104 of the flange 13 are aligned with the three sides of the cutout 82. Therefore, when the halves 110, 112 are joined to place the fixture 80 in the closed position as shown in FIG. 7B, the cutout 82 effectively captures the squared off sections of the flange 13 on the forward face of the barrel nut 12 and prevents rotational movement of the barrel nut while the lock nut is being tightened within the barrel nut's longitudinal bore 15. The portion of the fixture 80 located below the stops 81 (as shown in FIG. 7B) is configured to be grasped by a vice (not shown) or similar apparatus which is used to hold the fixture 80 in place when the fixture is being used to restrain the upper receiver 20.

Figure 8:
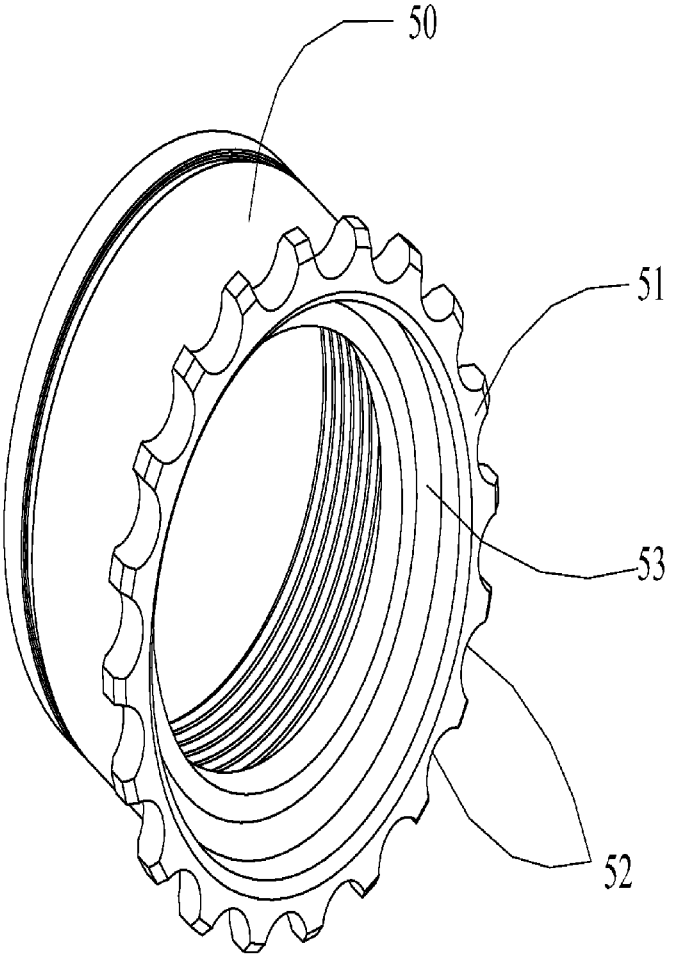
FIG. 8 is a perspective view of a prior art barrel nut.

A prior art barrel nut 50 is shown in FIG. 8. The prior art barrel nut 50 is configured to have a series of spokes 51 which define troughs 52 and an inner circumvolving edge 53 which holds the barrel 54, in connection with the barrel nut 50, in place on the upper receiver 55, shown in FIG. 9.

Figure 9:
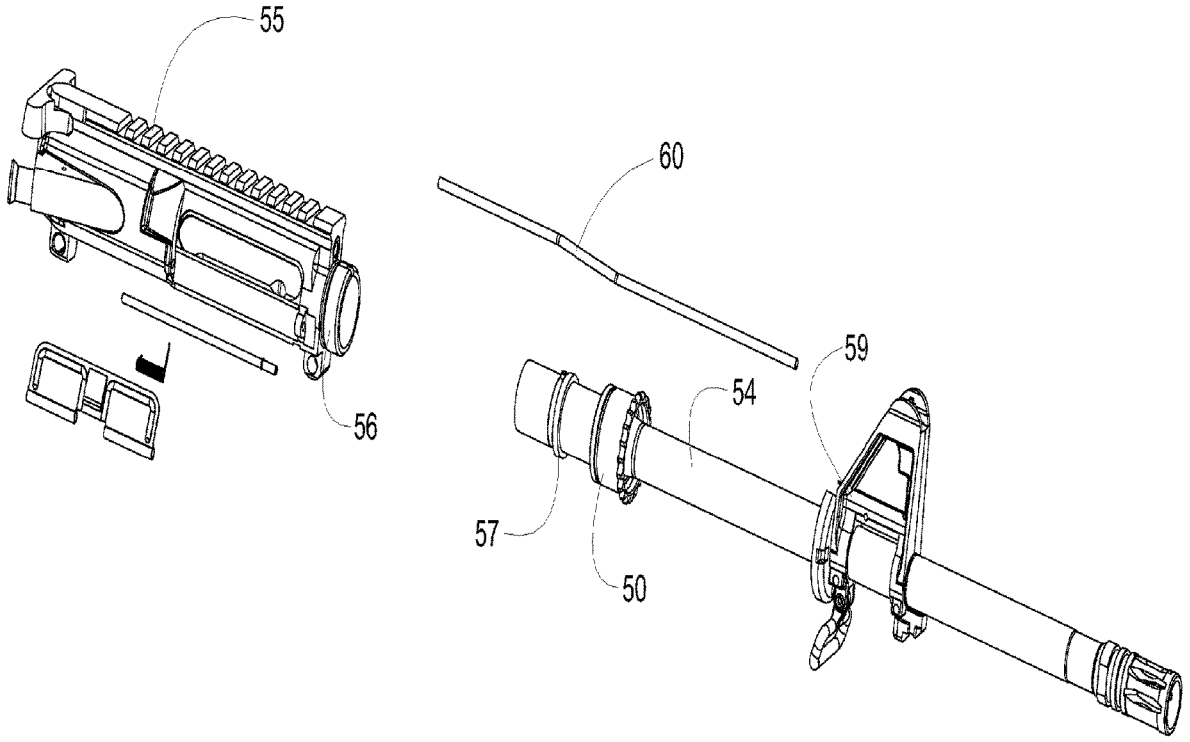
FIG. 9 is an exploded view of an upper receiver which uses a prior art barrel nut to secure the barrel to the receiver.

FIG. 9 illustrates an exploded view of a complete upper receiver assembly for an M16 type rifle using the prior art barrel nut 50 to secure the barrel 54 to the receiver 55. The rearward end of the barrel 54 is received by the threaded extension 56 of the receiver 55. The barrel nut 50 has a through bore which is configured to threadedly secure to the threads present on the threaded extension 56 of the receiver 55. The circumvolving edge 52 present within the interior of the barrel nut 50 secures the barrel 54 to the receiver 55 by placing force against the annular flange 57 of the barrel 54 and pushing it against the forward face of the threaded extension 56 of the receiver 55. There are a series of spokes 51 and troughs 52 present about the exterior of the barrel nut 50. When torque is being applied to the barrel nut 50 to secure the barrel 54 in place, the final positioning of the barrel nut has to place a trough 52 in alignment with an opening 58 present on the forward face of the receiver 55. When aligned with the opening 58 on the receiver, this trough allows the gas tube 60, or piston in some cases, to extend from the gas block 59 through the trough 52 and the opening 58 into the interior of the receiver 55 where the gas tube or piston is placed into communication with the bolt carrier, not shown but well known in the prior art.

If a spoke 51 of the prior art barrel nut is in line with the opening 58 on the receiver 55 when the barrel nut is torqued, the gas tube 60 cannot be properly installed, rendering the rifle inoperable. There is no effort to time the threads of the threaded extension 56 and the barrel nut 50 during the manufacturing process. As a result, during installation the barrel nut is often torqued into place multiple times in an attempt to properly align a trough 52 of the barrel nut with the opening 58 in the receiver 55. This can result in a situation where the alignment of a trough 52 with the opening in the receiver 55 will only occur by either over-torquing the barrel nut 50, under-torquing the barrel nut 50, or removing the barrel nut 50 entirely and starting over with a new barrel nut, which may have the same or a similar problem. In cases where the barrel nut 50 is over-torqued, the spokes 51, which are used in conjunction with a tool to apply torque to the barrel, can become brittle and break. This is a condition of particular concern when a piston is used in place of the gas tube 60, which is often supported on the spokes 51. Over-torquing the barrel nut 50 and thereby the barrel 54 can also negatively affect the accuracy of the host firearm.

To secure a barrel 30 to an upper receiver 20 of an M16 type firearm using the barrel nut assembly 10 in accordance with the present invention, the barrel nut 12 is threaded onto the threaded extension 21 of the upper receiver 20 until the barrel nut stops. The barrel nut is then reverse threaded until the through bore 18 of the bushing 16 is aligned with the opening 22 on the face of the receiver 20. The resulting subassembly of the upper receiver and the barrel nut is then placed within a fixture 80 which is secured within a vice to prevent any rotational movement of the barrel nut 12 and upper receiver 20. A barrel 30 of desired length is then selected, with the chamber end 23 thereof being inserted into the barrel nut 12 until the annular flange 31 of the barrel 30 is aligned with and comes to rest against the forward face 108 of the threaded extension 21 (see FIGS. 1 and 5). At the same time, the annular flange 31 is also contained within the interior of the barrel nut 12. The locknut 11 slides into and down the barrel and is then threadedly secured within the threaded bore 15 of the barrel nut 12. The locknut 11 is secured in place with the appropriate torque value using the wrench 40. The opening 144 of the wrench is of sufficient size to fit about the barrel 30, and the teeth 43 around the periphery of the opening are constructed to interface with the grooves 17 on the forward face of the locknut 11. A secondary wrench with a drive is then used to apply a predetermined torque value to the locknut 11, thus securing the locknut 11 and thereby the barrel 30 into place. The gas block 32 and flash hider 34 are then installed onto the barrel 30, the manner of which is well known in the prior art.

The piston assembly 33 is assembled in essentially the same manner as described in the '581 patent. Initially, the piston cup 35 is independently placed on the gas nozzle 36. The rear end of the operating rod 37 is then inserted into the through bore 18 of the bushing 16 and into the opening 22 of the receiver 20 by grasping the forward end of the operating rod 37 and thereby compressing the spring of the piston assembly 33. With the spring compressed, the operating rod 37 may be rotated into a position which places it in line with the rearward face of the piston cup 35. While holding the operating rod 37 in its compressed position, the connecting rod 29 is then inserted into the opening (not shown) present on the forward end of the operating rod 37. This assembly is then aligned with the opening (not shown) present on the back side of the piston cup 35 and released so that a forward portion of the connecting rod 29 is received by the opening on the back side of the piston cup 35, thereby holding the operating rod 37, connecting rod 29, and piston cup 35 in operational alignment. The chamfered edge 14 present at the opening of the through bore 18 facilitates the initial insertion or removal of the operating rod 37. Thus the installation of the new barrel nut assembly 10 has been described. By reversing the steps outlined above the barrel nut assembly 10 may be removed.

Figure 10:
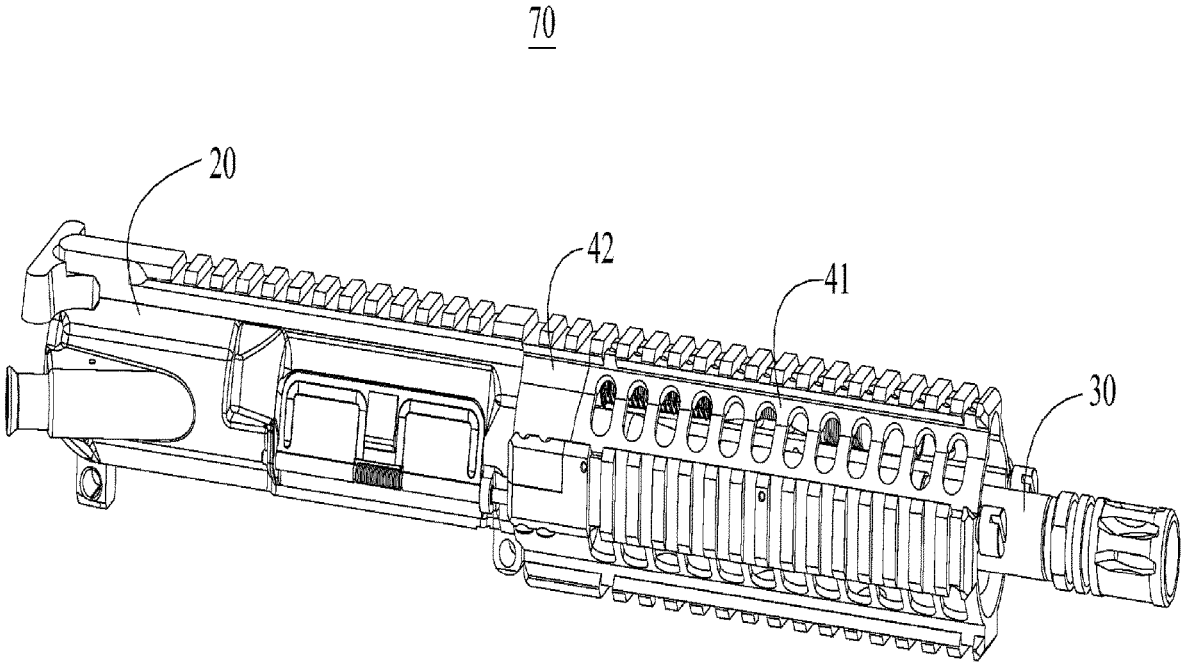
FIG. 10 is a side view of an upper receiver group using the barrel nut assembly of the present invention.
Figure 11:
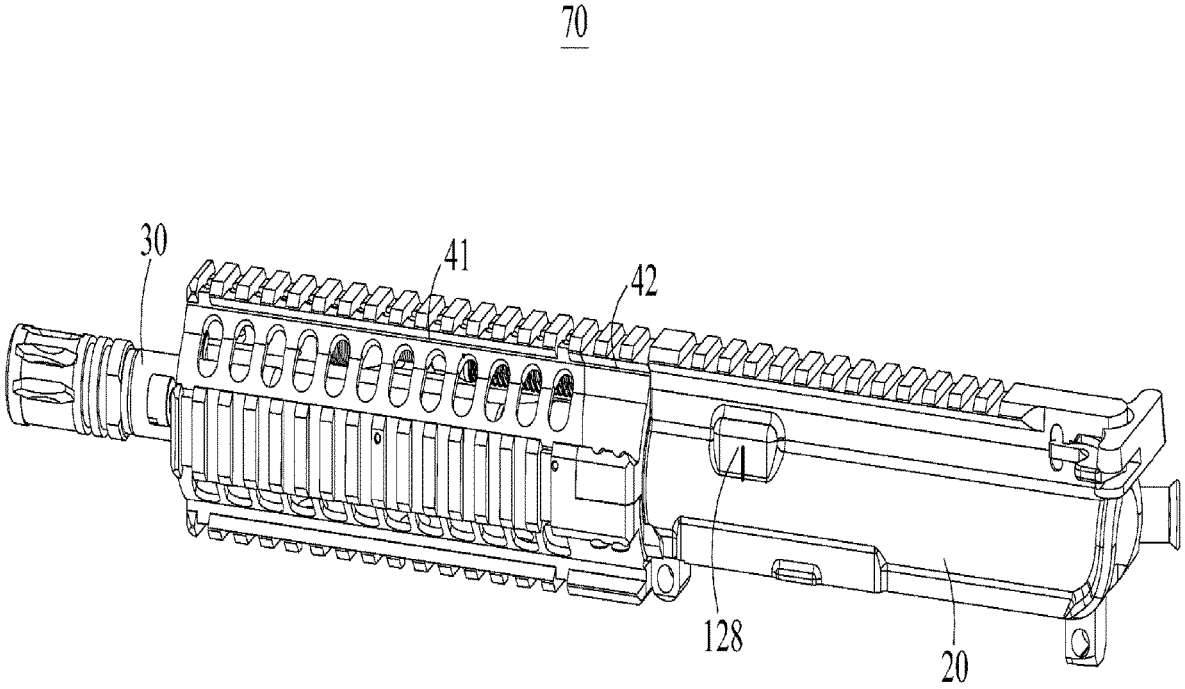
FIG. 11 is a left side view of the upper receiver group shown in FIG. 10.

FIGS. 10 and 11 show views of a complete upper receiver and barrel assembly 70 consisting of an upper receiver 20 with a barrel 30 that has been secured in place through the use of the barrel nut assembly 10 described herein. A handguard 41, being secured to the barrel nut 12 through the use of a clamp 42, has been installed to protect the user's hand from direct contact with the barrel 30 while the firearm is being operated. This handguard is fully disclosed in copending application Ser. No. 12/217,874, commonly owned by the assignee of the instant application. The clamp 42 used herein to secure the handguard to the barrel nut 12 has been configured to accommodate the bushing 16 present on the barrel nut 12 described herein.

An exterior projection 128 of the cam pin relief slot is shown in FIG. 11. The exterior projection 128 is generally rectangular in shape. It's presence on the upper receiver results from the need to machine a clearance slot on the interior of the receiver 20 for the cam pin of the bolt carrier group (not shown but well known in the prior art) to rotate, while at the same time not wanting an additional opening into the interior of the upper receiver 20.

It should also be noted that the piston assembly 33, gas nozzle 36 and gas block 32 may easily be replaced with the gas block 59, gas tube 60 and other components of prior art gas operating systems without departing from the purpose and advantage of the barrel nut assembly 10 of the present invention as described herein.

Figure 12:
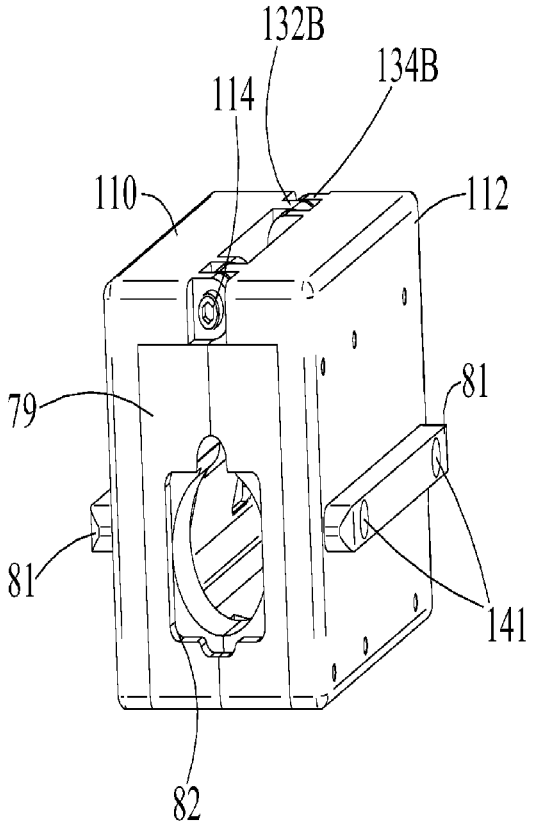
FIG. 12 shows a front perspective view of the fixture 80 in accordance with the present invention.
Figure 13B:
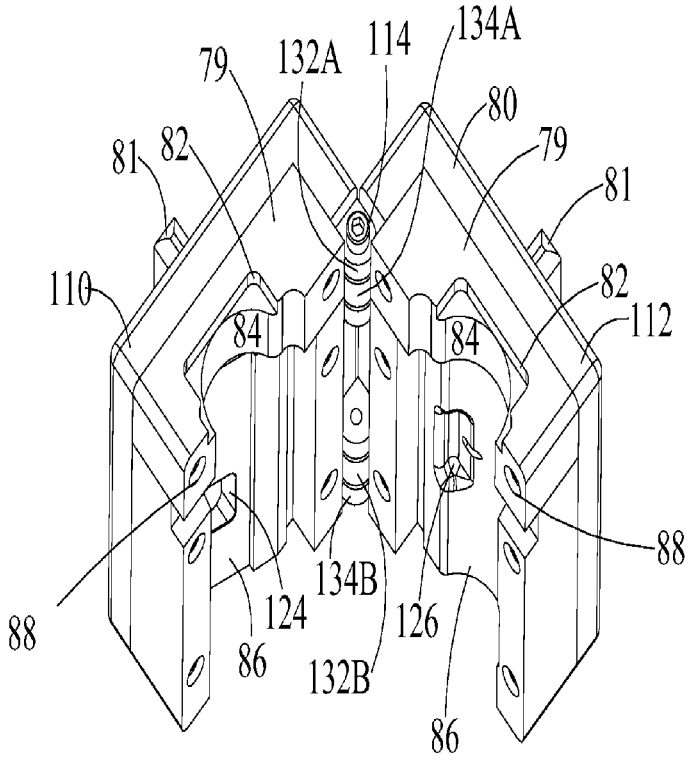
Figure 14:
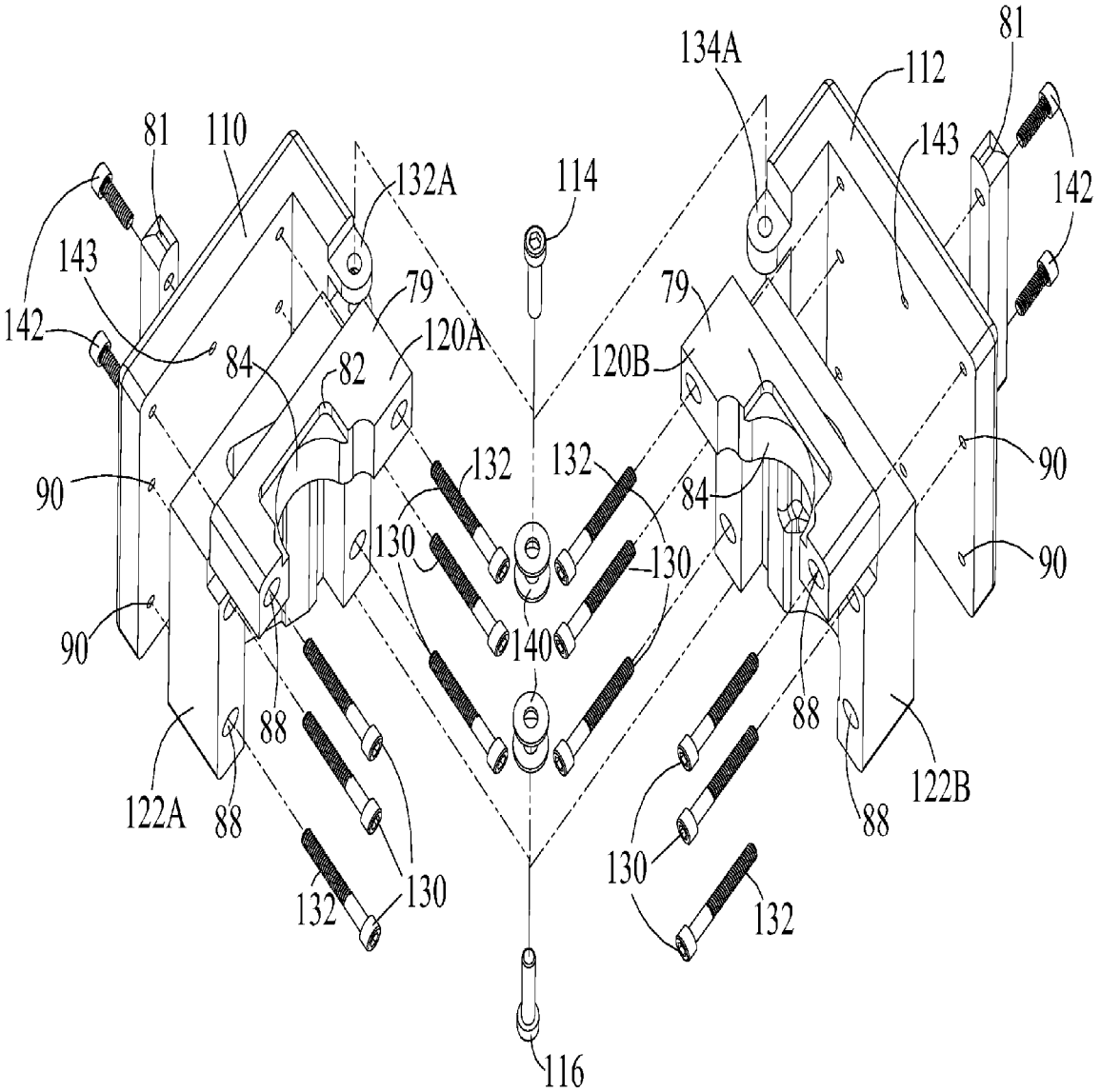
FIG. 14 shows an exploded view of the fixture shown in FIG. 12.

Shown in FIGS. 12 thru 14 are views of a fixture, generally designated by reference numeral 80. In one embodiment, the fixture 80 consists of two halves 110 and 112. The two halves are pivotally secured to each other through the use of pivots rods 114 and 116. Also provided are several removable inserts, collectively referred to as inserts 109. The primary inserts 120A and 120B define a forward face 79, interior portion 84 and a cutout 82. The forward face 79 has a cutout 82 which is configured to both receive the barrel nut's 12 squared off sections 104 and to rotationally restrain it during assembly. The interior 84 portion of the primary inserts 120A and 120B is configured to conform to the exterior profile of the barrel nut 12, the exterior profile being generally defined by the surface structure extending between the area located behind the flange 13, adjacent the front end 100, to the rear end 102 of the barrel nut 12. Pair of secondary inserts 122A and 122B is also provided. The secondary inserts 122A and 122B each define an interior 86 which is configured to conform to the exterior of the upper receiver 20. The secondary insert 122A is further configured to accommodate the shell deflector 24 (shown in FIG. 7A) of the upper receiver 20 within the provided recess 124. The recess 124 is generally rectangular in shape. The secondary insert 122B is further configured to receive an exterior projection 128 (shown in FIG. 11) of the upper receiver 20 within a provided recess 126. It should be understood that the primary inserts 120A and 120B along with the secondary inserts 122A and 122B may be constructed to accommodate upper receivers for M16/M4/AR15 type rifles which are not patterned after the prior art upper receiver 20 used when describing the preferred embodiment of the fixture 80 and barrel nut assembly 10.

The provided inserts 109 for the fixture 80 are secured to their respective halves 110 and 112 through the use of screws 130. Each screw 130 consists of a head portion at one end and a threaded portion 132 located at the opposite end. Each insert 109 has at least two openings 88 through it which are constructed to receive a screw 130. The screws 130 extend through these openings 88 allowing the threaded portion 132 of each screw to be threadedly secured within a provided bore 90. The bores 90 are present on each half 110 and 112 of the fixture 80, each bore being located adjacent to an opening 88. Each half of the fixture 80 has a portion of a structure that when assembled forms a hinge, designated by reference numeral 131. Each half 110 and 112 of the fixture has both a male and female portion of the hinge 131 structure. One half 110 of the fixture 80 has a male portion of the hinge 131 designated by reference numeral 132B and a female portion designated by reference numeral 132A. The other half 112 of the fixture 80 has a male portion designated by reference numeral 134A and a female portion designated by reference numeral 134B. Also provided for use with the hinge 131 are four washers 140. The stops 81 have the general shape of a rectangle and have two thru bores 141 present along their length. The thru bores 141 are configured to receive a screw 142 and allow it to pass through. The screw 142 is of similar construction to the screws 130 used to secure the inserts 109 in place, but has a shorter overall length. Located about the exterior of the fixture 80 are several threaded bores 143 configured to receive and threadedly retain the screws 142 and thereby the stops 81 in place.

To assemble the fixture 80, the hinge assembly 131 is initially assembled. Male portion 134A is received by female portion 132A and male portion 132B is received by female portion 134B. To secure the hinge 131 together, a washer 140 is placed in between each joint formed through the combination of male and female structures described above. The joint created through the combination of structures 132A and 134A is secured together by pivot rod 114, while the joint created by structures 132B and 134B are secured together by pivot rod 116. The pivot rods 114 and 116 are secured within their respective bores and threadedly received therein. One stop 81 is secured to each half 110 and 112 of the fixture 80 as described above. Inserts 120A and 122A are secured to half 110 of the fixture 80. Inserts 120B and 122B are secured to half 112 of the fixtures. The inserts 109 are secured in placed as described in the above paragraph. To disassemble the fixture 80, simply reverse the above outlined steps.

FIGS. 15A, 15B, 16A and 16B show views of another preferred embodiment fixture, generally designated by reference numeral 200. This fixture 200 is ideal for use on an assembly line where the cost consideration of the fixture 200 is outweighed by the manufacturing output increase and other advantages offered by the design. Some of these other advantages include providing a way to rapidly and consistently apply torque to the lock nut 11 and the virtual elimination of torque being transferred to the upper receiver 20 as a result of the lock nuts 11, and thereby the barrel nut assemblies 10, installation. The fixture 200 consists of a base 210 which is manufactured with a number of thru bores 211. The base 210 is manufactured from steel and of sufficient thickness to prevent bending or flexing during use. Bolts or screws may be used to secure the base 210 of the fixture 200 to a table or other appropriate work bench. Also present are a series of threaded bores, generally designated by reference numeral 215, which are configured to receive the screws used to secure the various provided sub-assemblies thereto. The sub-assemblies of the fixture 200 are comprised of the mandrel base 220, mandrel upper base 280 and the vertical toggle clamp 300.

Secured to the base 210 of the fixture 200 is a mandrel base 220. The mandrel base 220 has two thru bores 222 present on each side. The thru bores 222 are configured to align with the appropriate threaded bores 215 of the base 210 and to receive the provided screws 224 which secure the mandrel base 220 to the base 210 of the fixture 200. Located at the approximate center of the mandrel base 220 is a generally "U" shaped support structure 221. The generally "U" shaped support structure is manufactured to receive the back end 241 of the mandrel 220.

Also, provided on the support structure 221 are three bores, a first bore 228, a second bore 229 and a third bore 231. The first bore 228 is configured to receive an axial screw 225, or bolt, which is secured in place through the use of a washer 226 and a lock nut 227. A fender washer 223 which has a central opening large enough to accommodate the axial screw 225 is provided. Located only on one side of the support structure 221 is a third bore 231 (shown in FIG. 15B). The third bore 231 is configured to receive a ball detent 233 and spring 232. When the fixture 200 is fully assembled the spring 232 and ball detent 233 are secured in place by the fender washer 223. The second bore 229 is configured to receive the stop pin 230. The stop pin 230 is manufactured from steel and is press fitted into the second bore 229. Alternatively, an appropriately sized roll pin could be used as a stop pin. The mandrel 240 is configured to be secured to the mandrel base 220.

Figure 23:
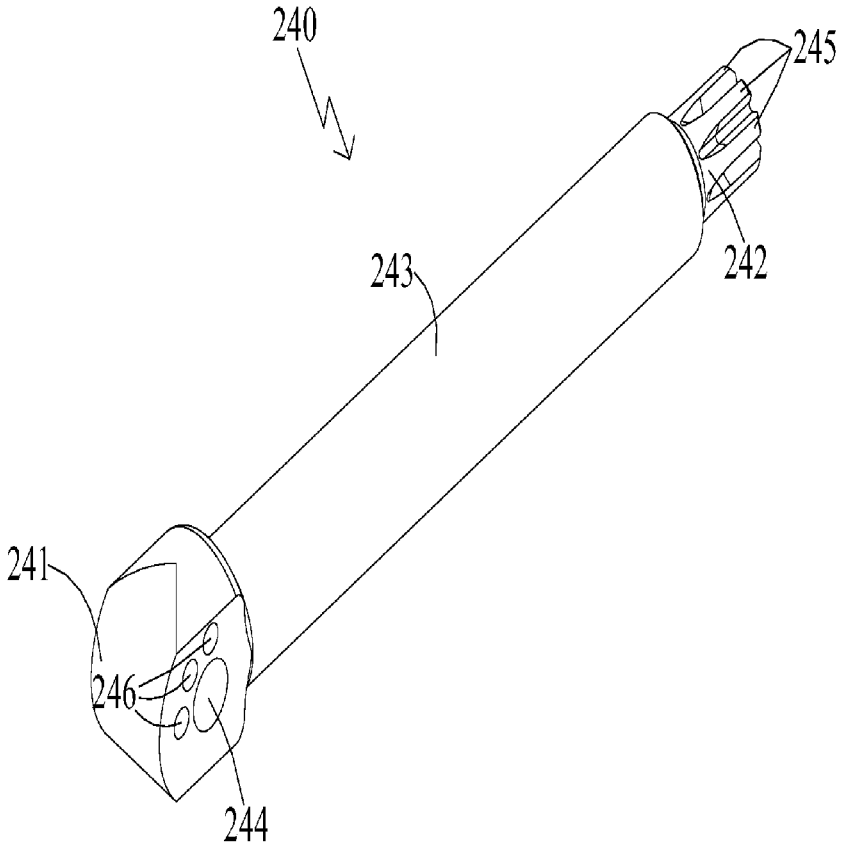
FIG. 23 shows a perspective view of the mandrel shown in FIG. 15A in accordance with the invention described herein.

The mandrel 240 is defined by a back end 241 and a front end 242 with a cylindrical body portion 243 extending therebetween. The front end 242 has a number of lugs 245 present about its exterior, the lugs 245 defining troughs in-between. The lugs 245 are sized and spaced sufficiently to engage with the receiving gaps 258 present on the barrel extension 255 (shown in FIG. 17). The cylindrical body portion 243 of the mandrel 240 is sized to be received by the interior opening of the upper receiver 20, where the bolt and bolt carrier are typically received. The back end 241 of the mandrel 240 has a thru bore 244 which is configured to receive and allow passage of the axial screw 225 during assembly of the mandrel base 220. The axial screw 225 is configured to allow the mandrel 240 to freely rotate. Located on the side of the mandrels 240 back end 241, adjacent the third bore 231 which houses the ball detent 233 and spring 232, are a series of indentations 246 (as shown in FIG. 15B and FIG. 23). In the preferred embodiment there are three indentations 246. When the ball detent 233 engages with an indentation 246 of the mandrel 240 it is held in a semi-fixed position until sufficient pressure is applied to the mandrel 240 in order to move it into another position within its range of motion. The three indentations 246 found on the preferred embodiment (shown in FIG. 23) provide for the mandrel 240 to be held in a horizontal position, a 45 degree position and a 90 degree position, relative to the base 210 of the fixture 200. The stop pin 230 prevents the mandrel 240 from rotating passed the 90 degree position by pressing against a portion of the mandrels 240 back end 241.

Figure 15A:
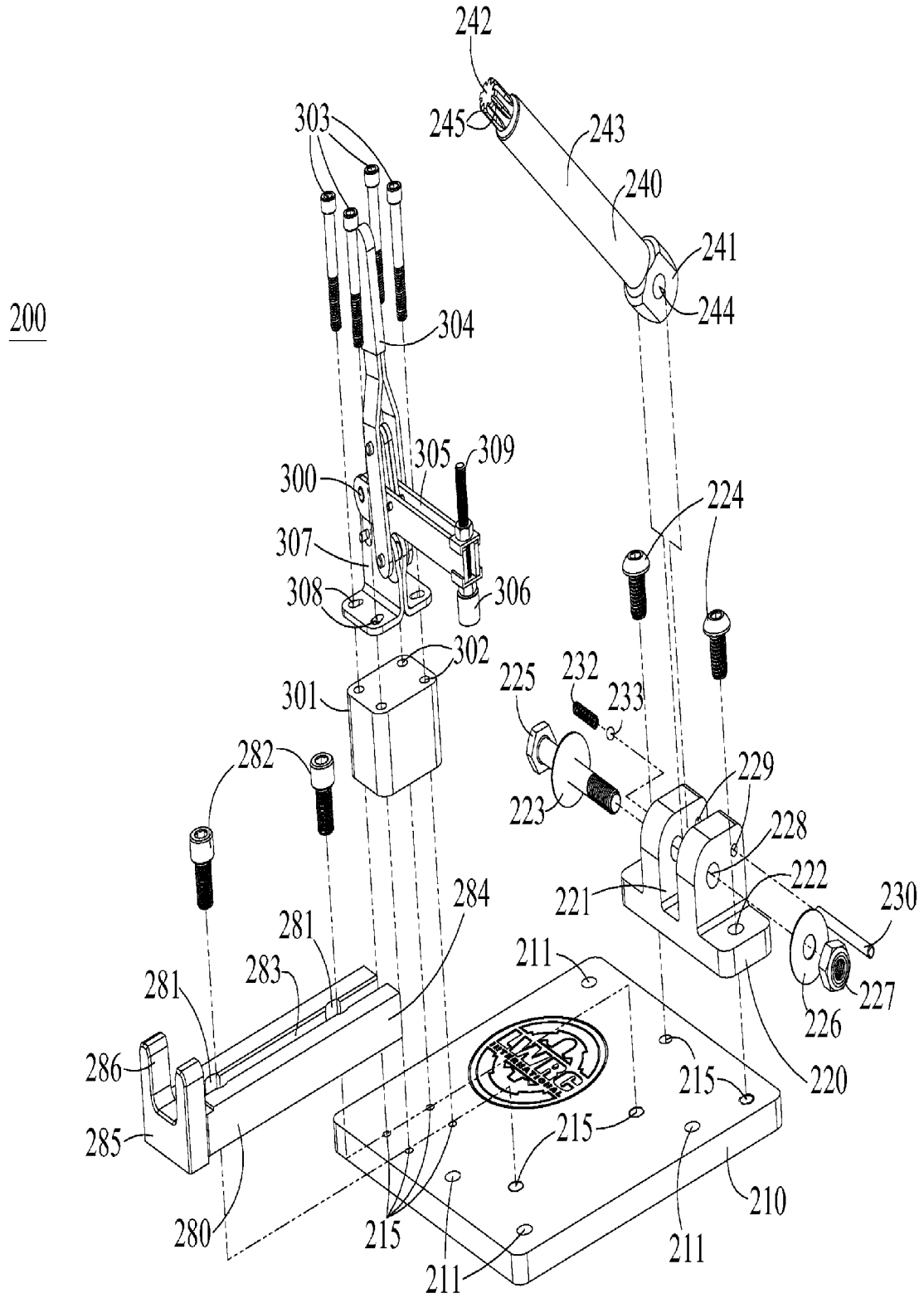
FIGS. 15A and 15B show exploded views of an alternate embodiment fixture 200 in accordance with the present invention, the image shown in 15B is rotated 180 degrees from the position of the fixture as shown in FIG. 15A.
Figure 15B:
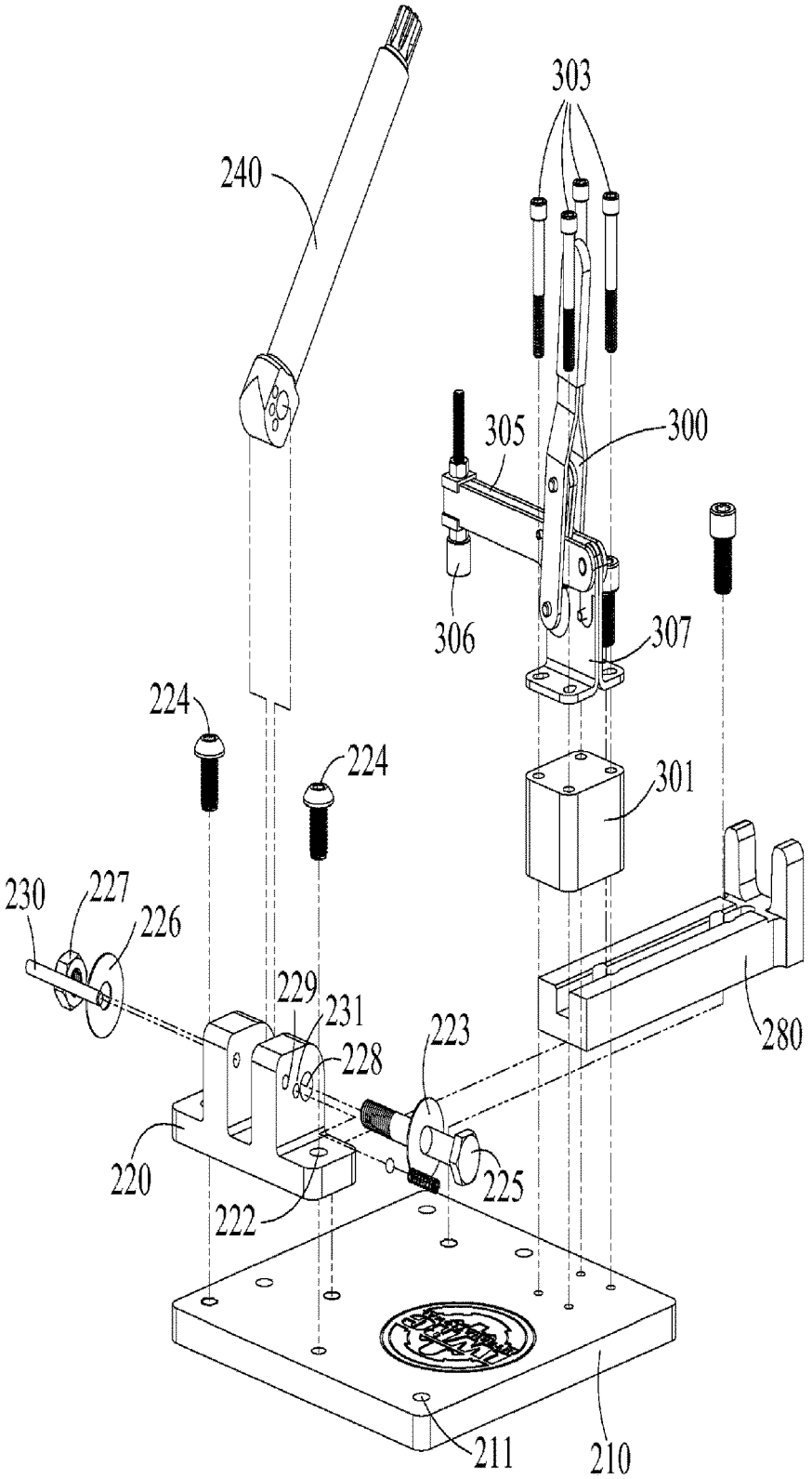
Figure 21:
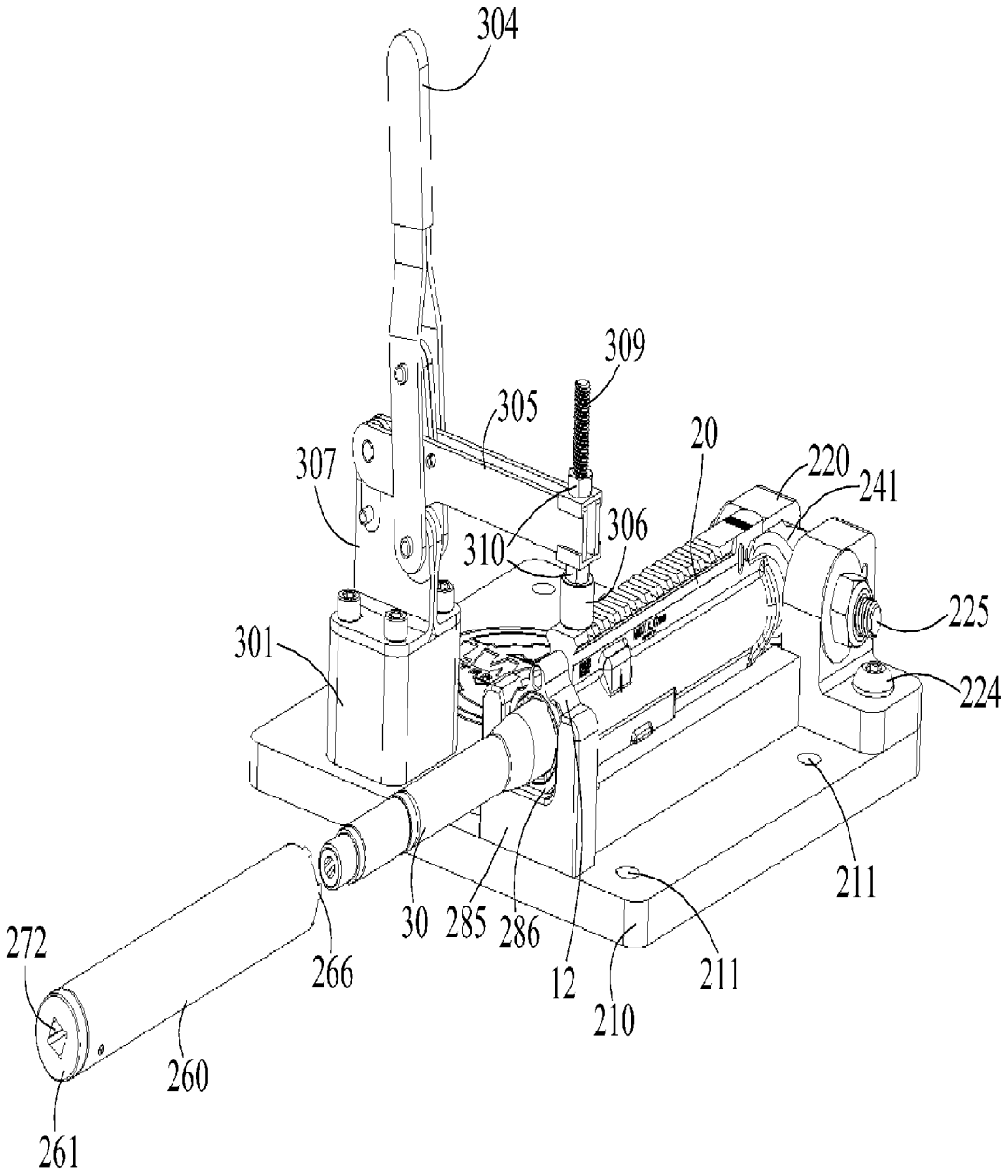
FIG. 21 shows a perspective view of an upper receiver equipped with the barrel nut assembly of the present invention secured in the fixture 200 with the vertical clamp in the second position.
Figure 22:
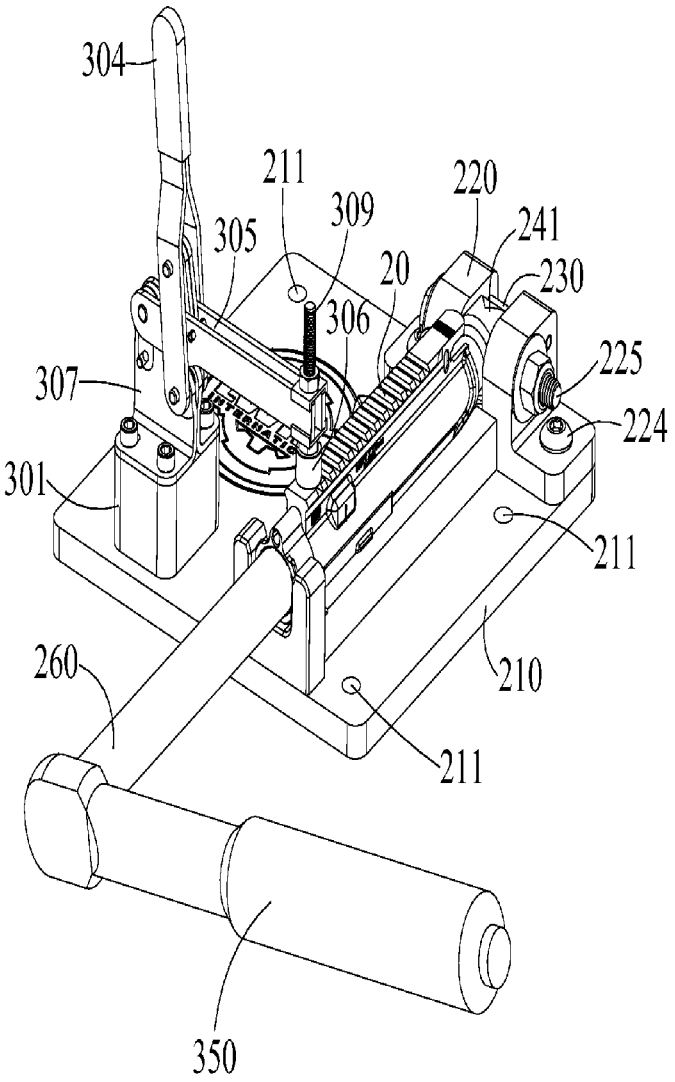
FIG. 22 is a side perspective view of a locknut being secured with a wrench to an upper receiver equipped with the barrel nut assembly of the present invention while secured in a fixture 200.

The mandrel upper base 280 (shown in FIGS. 15 and 16) has two thru bores 281 present along its longitudinal axis, each configured to receive a screw 282 constructed to secure it to the fixture 200 base 210 by threadedly engaging with the appropriately placed threaded bores 215 (shown in FIGS. 15A and 15B). The mandrel upper base 280 defines an interior trough 283, a back end 284, and a front end 285. The mandrel upper base 280 as a whole is configured to provide additional support to the upper receiver 20 and barrel nut assembly 10 during installation of the locknut 11. The trough 283 is constructed to receive a portion of the upper receiver 20 and to provide a place for it to rest against. Further, the trough 283 is attached to the base 210 such that its center line is aligned with the approximate center line of the mandrel 243. When attached to the base 210, the back end 284 of the mandrel upper base 280 is located adjacent to the mandrel base 220. In particular, the front end 285 of the mandrel upper base 280 has a cutout 286. The cutout 286 has two opposed sides and a bottom which form three sides of a square. The top or fourth side is absent to facilitate the receipt of the barrel nut assembly 10. When the upper receiver 20 and barrel nut 20 are positioned in the mandrel upper base 280, the three squared off sections 104 of the flange 13 are aligned with the three sides of the cutout 286. Therefore, when the mandrel 240 is positioned to place the upper receiver 20 and barrel nut assembly 10 into position on the mandrel upper base 280 as shown in FIGS. 21 and 22, the cutout 286 effectively captures the squared off sections of the flange 13 on the forward face of the barrel nut 12 and assist in preventing rotational movement of the barrel nut while the lock nut is being tightened within the barrel nut's longitudinal bore 15. The upper receiver 20 is further secured from unintentional movement through the use of the vertical toggle clamp 300 (shown in FIGS. 16A, 16B and 21).

The vertical toggle clamp 300, also referred to herein as a "vertical clamp", is a subassembly of the fixture 200. The vertical toggle clamp 300 is purchased as an assembly, the assemblies are well known throughout the prior art and are readily available from commercial sources. Broadly stated, the vertical clamp is comprised of a frame 307, a handle 304, arm 305, and a synthetic bumper 306 assembly, or components capable of providing the same benefit. In addition, a base 301 constructed of metal, wood or a durable polymer is provided to elevate the vertical toggle clamp 300. Located adjacent to the mandrel upper base 280, the vertical toggle clamp 300 is elevated by the provided base 301. The frame 307 of the vertical clamp has four openings 308 which are spaced to align with the four thru bores 302 of the base 301. The openings 208 and the thru bores 302, of the frame 307 and base 301 respectively, are configured to allow for the passages of screws 303 which are configured to threadedly engage with the threaded bores 215 of the fixture 200 base 210. The handle 304 is connected to the frame 307 and in communication with the arm 305. The arm 305 has a screw 309 secured about its forward end which is threadedly secured to a bumper 306. The screw 309 is received through an opening provided on the arm 305 and relies on two threaded nuts 310 to secure it in place.

Adjustment of the bumpers 305 location relative to the arm 305 is effected by loosening and tightening these two nuts 310. The vertical toggle clamp 300 is movable between a first position (not shown) and a second position (see FIG. 21). The first position has the arm 305 and thereby the bumper 306 held in a position such that neither is blocking the travel path of the mandrel 240. The second position has the handle 304 in a vertical position, the arm 305 in a horizontal orientation thereby placing the bumper 306 against a top portion of the upper receiver 20. The amount of downward force being placed by the vertical clamp 300 onto the upper receiver 20 may be varied by adjusting the bumper 306 position relative to the arm 305. The screw 309 to which the bumper is secured may be rotated clockwise or counter-clockwise to either decrease or increase, respectively, the distance that bumper 306 protrudes from the arm 305 of the vertical clamp 300. By increasing the distance that the bumper 306 protrudes from the arm 305, the pressure exerted by the arm 305 on the upper receiver 20 increases when the vertical clamp is moved from the first position to the second position.

Figure 17:
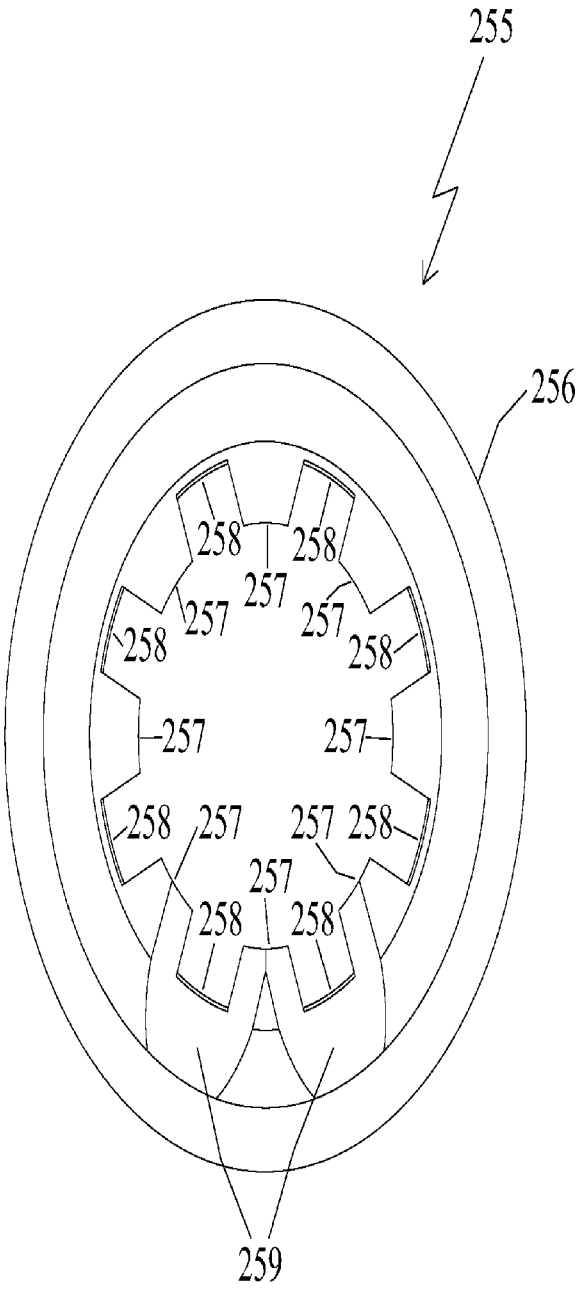
FIG. 17 is an end view of the barrel extension of the rifle barrel depicted in FIG. 1.

Shown in FIG. 17 is a barrel extension, generally designated by reference numeral 255. The barrel extension 255 is secured to the barrel 30, located about the chamber end 23 of the barrel 30 and is constructed to receive the bolt which is housed in the fully assembled upper receiver 70 of the host firearm. The preferred embodiment of the bolt is fully disclosed in copending application Ser. No. 13/588,294 filed on Aug. 17, 2012, commonly owned by the assignee of the instant application and is incorporated by reference as if set forth fully herein. The bolt receiving end 256 of the barrel extension 255 has a number of extension lugs 257 spaced about its interior. The extension lugs 257 define receiving gaps 258 therebetween which are of sufficient size to allow the passage of a bolt's lugs. Under routine operating conditions a bolt's lugs pass between the extension lugs 257, thru the receiving gaps 258 until the bolt reaches the end of its longitudinal travel path. Approximate the end of this travel path, the bolt begins to rotate placing each of its lugs behind the extension lugs 257 of the barrel extension 255. Located adjacent to two of the receiving gaps 258 are two feed ramps 259. The feed ramps 259 guide loaded ammunition cartridges into the chamber of the rifle barrel 30.

Figure 16A:
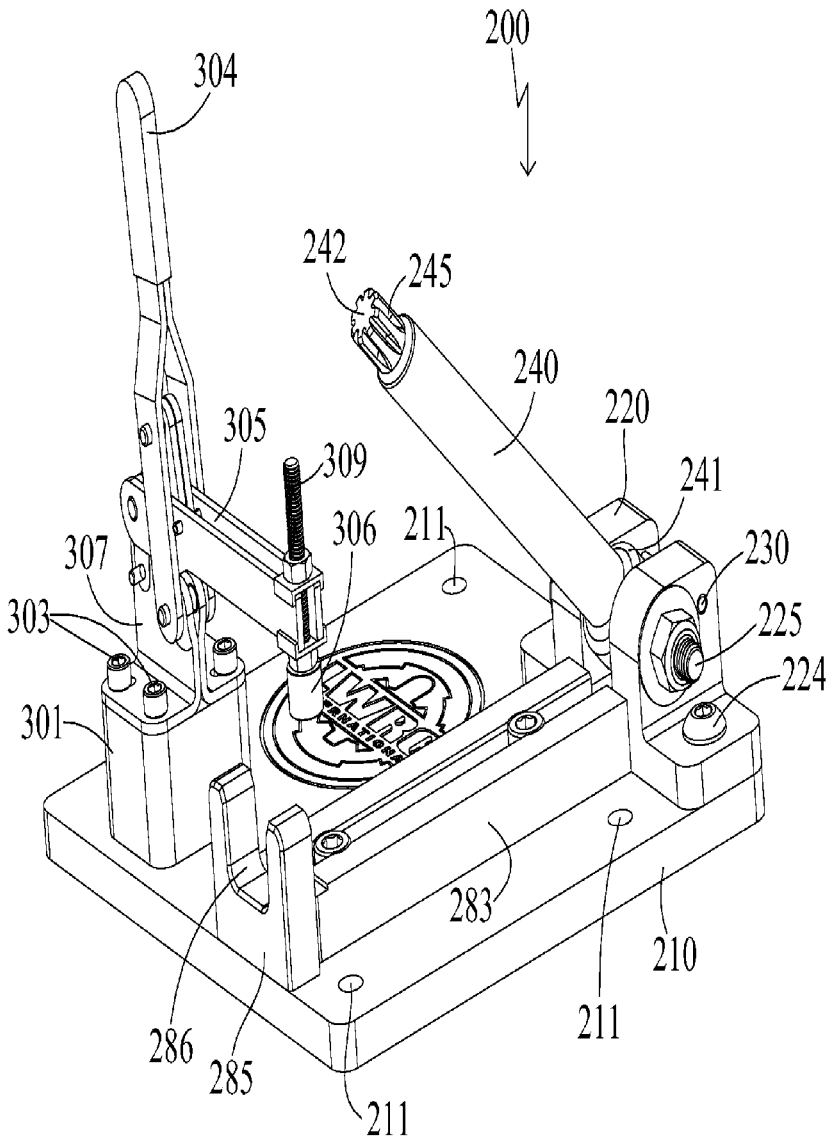
FIGS. 16A and 16B show side perspective views of the fixture shown in FIG. 15 assembled, the fixture shown in FIG. 16B is rotated 180 degrees from the position shown in FIG. 16A.
Figure 16B:
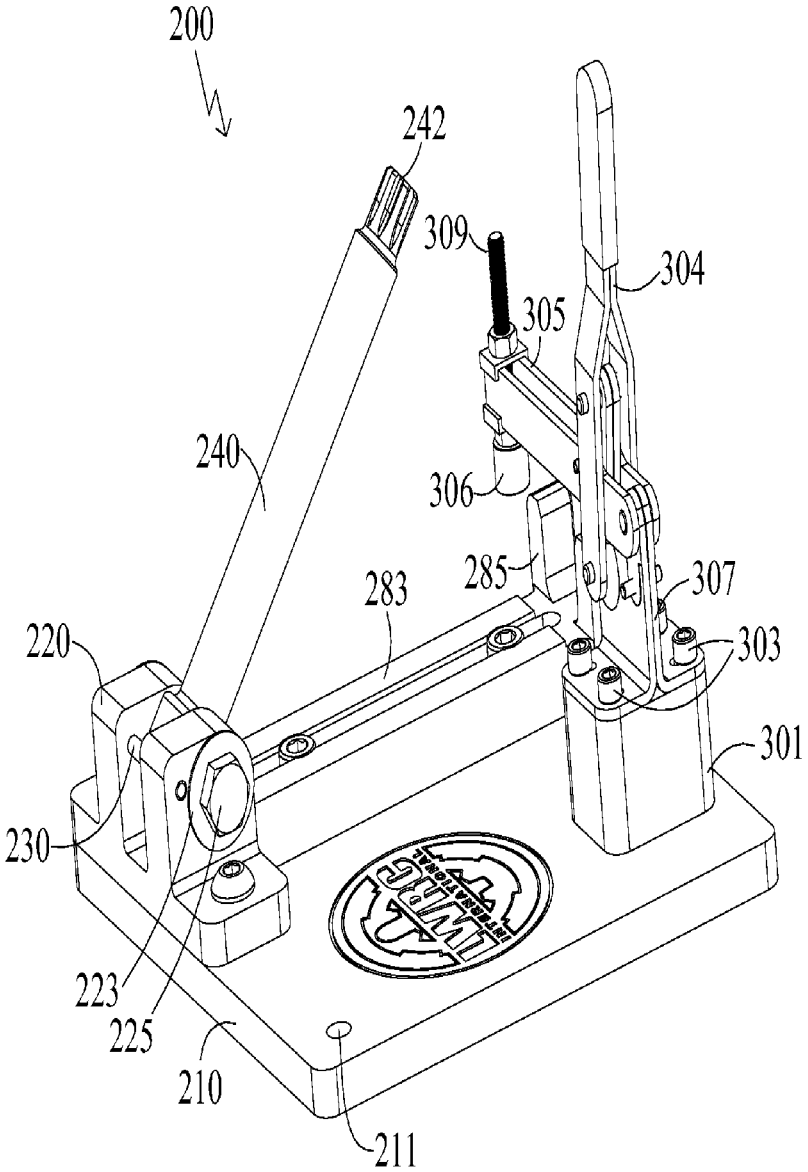
Figure 18:
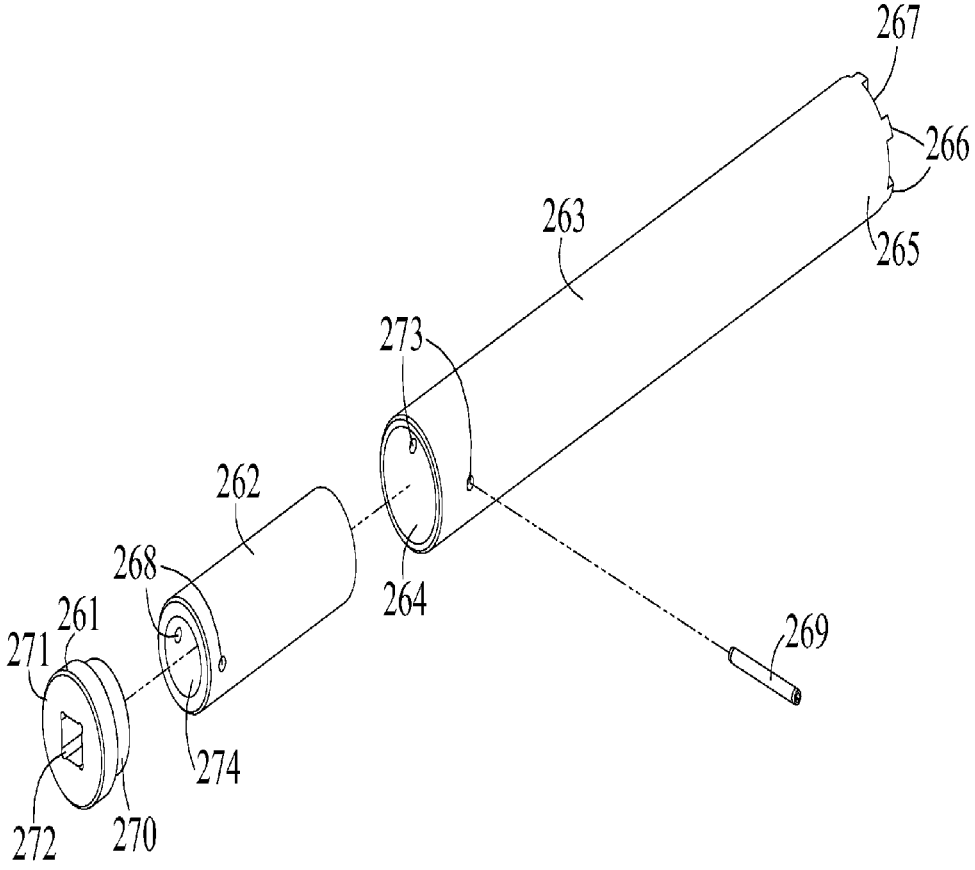
FIG. 18 is an exploded view of a specialized wrench used to secure the locknut against the annular flange of the barrel when securing the barrel to the upper receiver, as shown in FIG. 20.

Shown in FIG. 18 is an exploded view of the wrench, generally designated by reference numeral 260, which is used with the fixture 200 shown in FIGS. 16A and 16B. The wrench 260 consists of three primary components, a head piece 261, a connecting member 262 and the body portion 263. The body portion 263 is a hollow cylinder with an opening 264 at one end and an engagement portion 265 at the other. The interior of the opening 264 has been constructed to have sufficient internal length and diameter to accommodate the barrel which is being selected for installation. The engagement portion 265 of the wrench is generally circular and includes a gripping structure embodied as a plurality of teeth 266 which project outwardly from the forward edge 267 (see FIG. 20). The teeth 266 are generally perpendicular to the face of the forward edge 267 and are configured to engage with the grooves 17 on the front face of the lock nut 11 (see FIGS. 4 and 22). The connecting member 262 is generally cylindrical in shape and is configured to be received within the opening 264 of the body portion 263. The connecting member 262 has an opening 268 which runs perpendicular to its longitudinal axis that is configured to receive a roll pin. When the connecting member 262 is received within the body portion 263, the opening 268 of the body portion 262 is aligned with the opening 268 of the connecting member 262. A roll pin 269 is driven through the two openings 268 and 269 once they are aligned, thereby securing the body portion 263 and connecting member 262 together.

Figure 19:
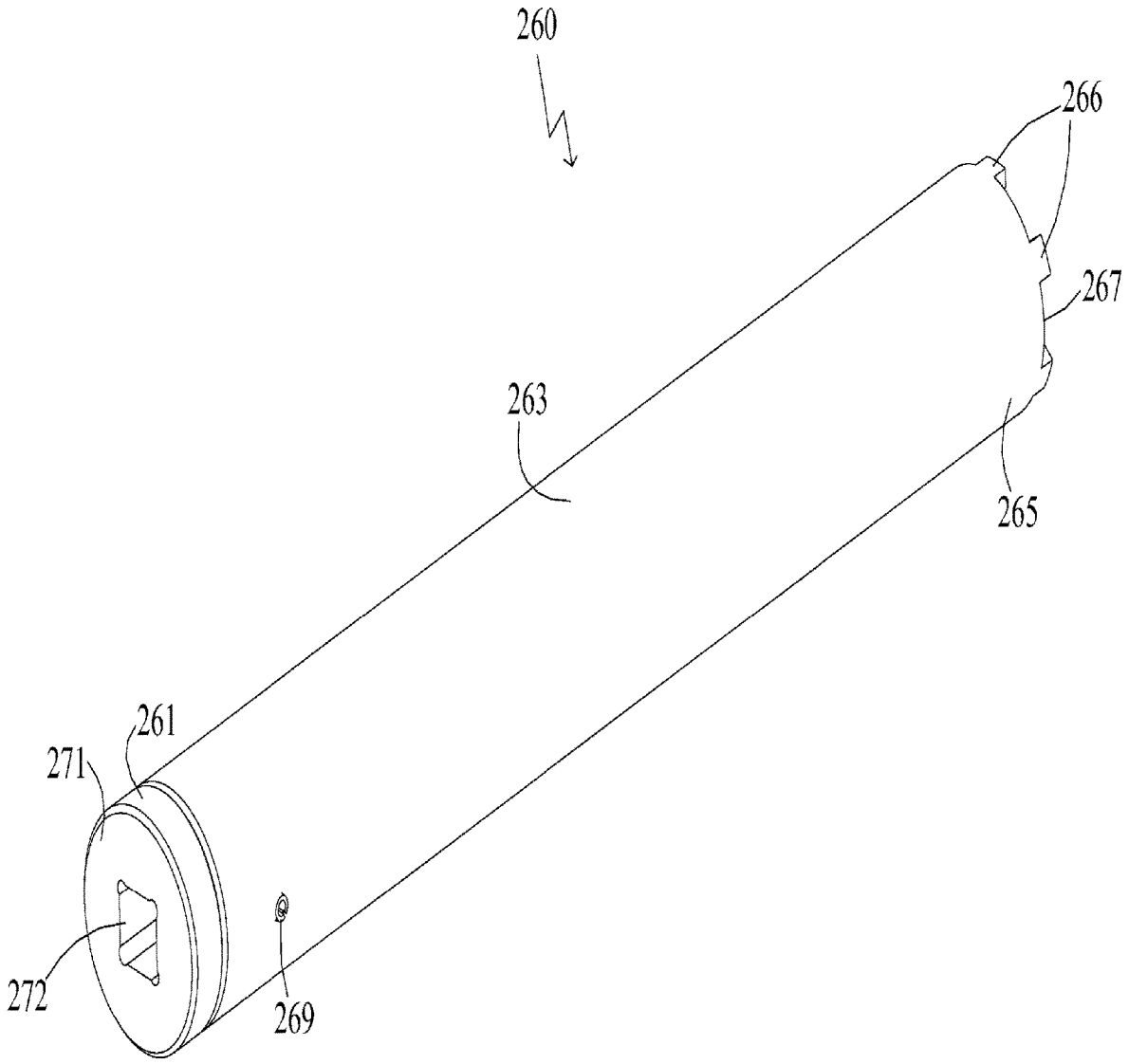
FIG. 19 is a perspective view of the wrench assembly shown in FIG. 18.
Figure 20:
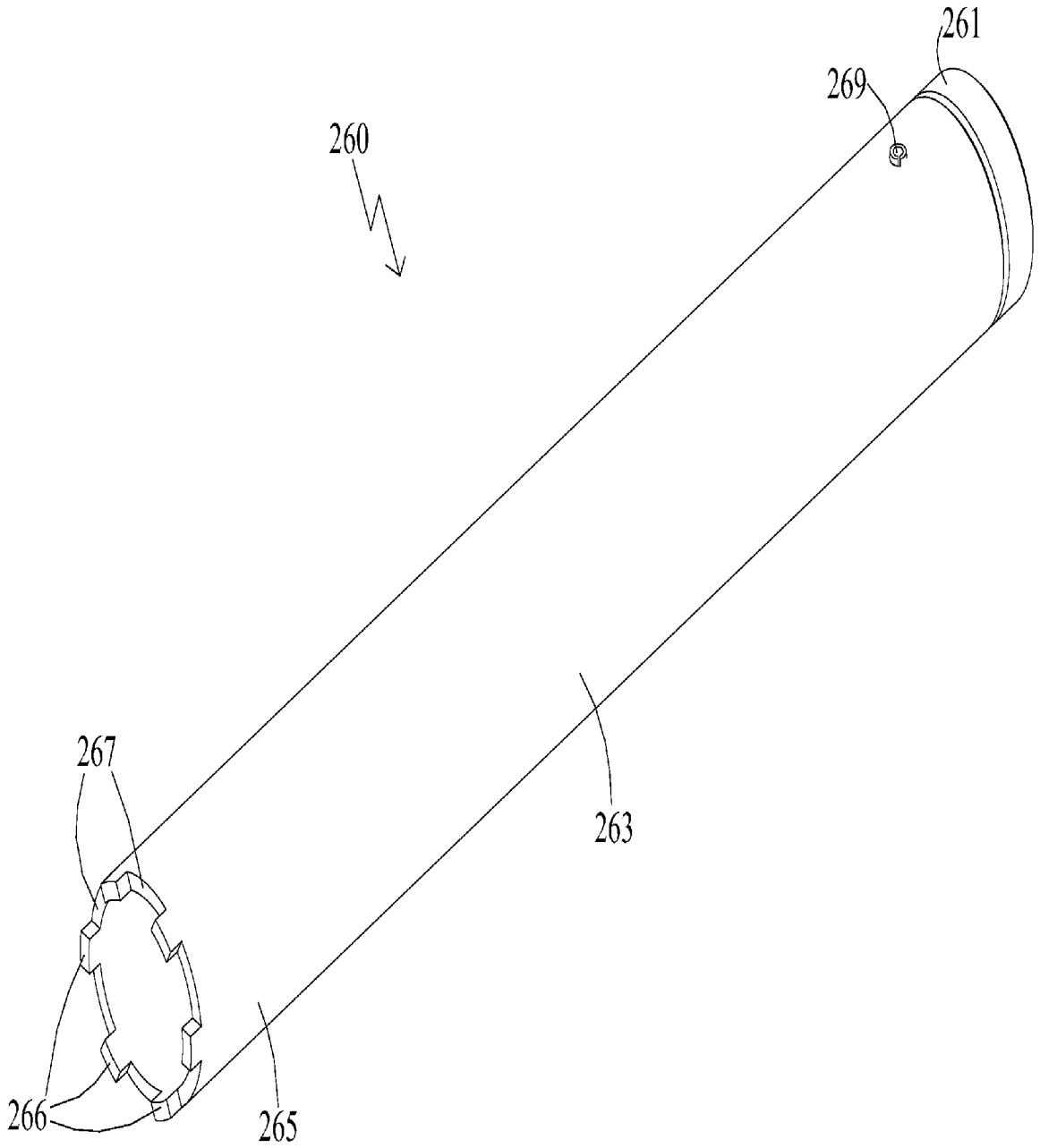
FIG. 20 shows a perspective view of the wrench assembly of FIG. 18, rotated 180 degrees about a vertical axis.

The head piece 261 of the wrench 260 assembly defines a front end 270 and a back end 271. The front end 270 is turned in a lathe until it fits within the opening 274 thru the connecting member 262, at which point the head piece 261 is welded to the connecting member 262. The assembled wrench 260 is shown in FIGS. 19 and 20. The back end 271 has an external diameter which is larger than the external diameter of the area which defines the front end 270 of the head piece 261. Located about the center line of the head pieces 261 back end 271 is an aperture 272 configured to receive a drive member of a wrench. While the aperture 272 is configured to receive the drive of virtually any conventional socket or torque wrench, with the preferred embodiment a pneumatic torque wrench is used.

The fixture 200 is assembled as follows. The mandrel base 220 is oriented so that its two thru bores 222 are aligned with the appropriate threaded bores 215 provided on the base 210. Screws 224 are used to threadedly secure the mandrel base 220 to the fixture base 210. The stop pin 230 is then driven into the second bore provided on the "U" shaped support structure 221 of the mandrel base 220. The mandrel 240 is oriented and inserted into the opening 221 of the support structure 220 so that the bore 244 located thru its back end 241 is aligned with the first bore 228 of the mandrel base 220. An axial screw 225, with a fender washer 223, is inserted through the first bore 228 of the mandrel base 220 and the bore 244 located on the mandrel 240. Just prior to seating the fender washer 223 against the side of the support structure 221, the ball 233 and spring 232, in the order, are inserted into the third bore 231 and retained in place by the fender washer 223. The axial screw 225 is secured to the mandrel base 220 thru the use of a washer 226 and the lock nut 227, thereby securing the mandrel 240 to the mandrel base 220.

Next, the mandrel upper base 280 is secured to the base 210 of the fixture 200. The mandrel upper base 280 is oriented so that the two thru bores 281 provided thereon are in alignment with the appropriately placed threaded bores 215 of the base. Screws 282 are used to threadedly secure the mandrel upper base 280 to the fixture base 210. The back end 284 should be adjacent to the mandrel base 220.

To install the vertical toggle clamp 300, the thru bores 302 of the base 301 are initially aligned with the threaded bores 211 provided for on the fixture base 210. Next, the openings 308 provided for on the frame 307 are aligned with the thru bores 302 of the base 301, four screws 303 are then inserted thru the provided openings 309, thru bores 302 and threadedly secured to the threaded bores 215 provided for on the base 210 of the fixture 200, thereby securing the vertical toggle clamp 300 and base 301 to the base 210 of the fixture.

To disassemble the fixture 300, simply reverse the steps outlined above. Alternatively, to maintenance or replace any sub-assembly of the fixture 200, simply reverse the steps outlined above as specified for the specific sub-assembly of interest.

To install a barrel 30 onto the receiver 20 of a firearm, with the barrel nut assembly 10 described herein, using the second preferred embodiment fixture 200, the following steps should be followed, or variations which would be obvious to one skilled in the art. Initially the mandrel 240 should be placed so that it is at a 45 degree or 90 degree angle with regards to the base 210 of the fixture 200. The upper receiver 20 is then oriented so that the mandrel 240 may be inserted and received within the interior opening of the upper receiver 20, the same interior opening where the bolt and bolt carrier group of an AR15/M16 type rifle/carbine is inserted. Next, the barrel nut is threaded onto the threaded extension 21 of the upper receiver 20 until the barrel nut stops. The barrel nut is then reverse threaded until the through bore 18 of the bushing 16 is aligned with the opening 22 on the face of the receiver 20. The mandrel with a subassembly consisting of the upper receiver and barrel nut is rotated so that the mandrel is in a horizontal position as shown in FIGS. 21 and 22. This places the bottom of the upper receiver 20 against the top surface of the mandrel upper base 280, with portions of the upper receiver 20 being received within the interior trough portion 283. The portions of the upper receiver received within the mandrel upper base 280 are the take down pin lugs 150 (see FIG. 1). Occurring simultaneously, the barrel nut 11 of the subassembly is being received within the cutout 286 located on the front end 285, the cutout 286 effectively capturing the squared off sections of the flange 13 located on the forward face of the barrel nut 12. After the upper receiver 20 is secured to the mandrel upper base 280, the handle 304 of the vertical clamp 300 is used to move the arm 305 from the first position into its second position. The arm 205 of the vertical clamp 300 in conjunction with the bumper 306 places a downward force on the upper receiver 20, thereby further retaining it within the mandrel upper base 280.

Next, a firearm barrel 30 of the desired length is then selected, the barrel extension 255 thereof being inserted into the barrel nut 12 until the annular flange 31 of the barrel 30 is aligned with and comes to rest against the forward face 108 of the threaded extension 21 (shown FIGS. 1 and 5). At the same time, the annular flange 31 is also contained within the interior of the barrel nut 12. While the firearm barrel 30 is being seated against the forward face 108 of the threaded extension, the front end 242 of the mandrel 240 is being received by the barrel extension 255. More specifically, the mandrel's lugs 245 are received within the receiving gaps 258 present about the interior of the barrel extension 255. This interaction between the mandrel lugs 245 and the receiving gaps 258 of the barrel extension 255 rotationally restrain the barrel during assembly. The locknut 11 slides onto and down the barrel 30 and is then threadedly secured within the threaded bore 15 of the barrel nut 12 using the provided wrench 260. The locknut 11 is secured in place with the appropriate torque value using the provided wrench 260 in combination with a pneumatic torque wrench 350 (see FIG. 22). While a pneumatic torque wrench 350 is used with this particular embodiment of the fixture 200, a prior art manually operated socket or torque wrench could be used.

Once the locknut 11, and thereby the barrel nut assembly 10, is secured in place, the wrench 260 is removed. At this point the piston assembly 33, gas block 32 and flash hider 34 are then installed as described above.

The provided fixture 200, the assembly and use of which has been described above, eliminates torque originating from the installation of the locknut 11 from transferring to the upper receiver 20. While the lock nut 11 is being secured to the barrel nut 12, the lock nut 11 initially comes to rest against the annular flange 31 of the rifle barrel 30 which is in turn seated against the forward face 108 of the receiver (shown in FIGS. 1& 5). Without the lugs 245 of the mandrel 240 being engaged with the receiving gaps 258 of the barrel extension 255, some of the torque being applied to the locknut 11 would transfer through the annular flange 31 of the barrel 30 into the threaded extension 21 of the upper receiver 20. This transfer of torque would otherwise occur because the receiver 20 is naturally resisting the rotational movement of the barrel while the locknut 11 is rotating against the annular flange 31 of the barrel during assembly. When the present fixture 200 is used, torque being applied to the locknut 11 is only transferred to the annular flange 31 of the barrel which is unable to rotate due to the lugs 245 of the mandrel 240 being engaged with the receiving gaps 258 of the barrel extension 255. Thus, the herein described fixture 200 eliminates torque originating from the installation of the locknut 11 from being transferred to the receiver 20 of the firearm.

The herein describe benefits associated with the use of the fixture 200 shown in FIGS. 15A, 15B, 16A, 16B, 21A, 21B, and is not limited to use with the preferred embodiment barrel nut assembly described herein. A fixture substantially similar to the fixture 200 could be manufactured to work with the prior art barrel nut (see FIG. 8), barrel nuts of similar design, and with designs similar to the barrel nut assembly 10 described herein. By omitting the front end 285 of the mandrel upper base 280 the receiver and barrel would be restrained thereto through the use of a vertical clamp and the mandrel, respectively. A wrench appropriate for installation of the prior art barrel nut would necessarily be substituted for the one used with the preferred embodiment of the herein disclosed barrel nut assembly. While the prior art barrel nut, or one of similar shape is being installed, no torque would transfer to the receiver as a result of torque being applied to the barrel nut for the reasons specified above.

CONCLUSION, RAMIFICATIONS, AND SCOPE

Accordingly, the barrel nut assembly according to the present invention provides an apparatus and method for securing a barrel to the receiver of a firearm. The barrel nut has an integral bushing 16 with a through bore 18 that is aligned with the opening 22 in the receiver so that the operating rod 37 of the piston assembly 33 may pass unhindered into the interior of the receiver. By supporting the operating rod of the piston assembly, the integral bushing provides a more robust means of supporting the operating rod and is not prone to structural failure as are the spokes of a conventional barrel nut, the disadvantages of which have been described above.

In addition, the provided method of orienting the through bore 18 of the bushing 16 with the opening 22 of the receiver is independent of the torque applied to the locknut used to secure the barrel to the receiver, offering the significant advantage of being able to use a consistent, preset torque value to secure the barrel to the receiver. This use of a consistent, preset torque value is an advantage as compared to prior art methods of securing a barrel to a receiver through the use of a conventional barrel nut.

Further still, there has been provided a fixture and method of its use whereby the torque inherent to the installation of a barrel to a firearm receiver by way of a barrel nut is transferred to the barrel and not the receiver. The significant advantage of this fixture is that the receiver is not warped, stressed or otherwise damaged during barrel installation.

While there is shown and described the present preferred embodiment of the invention, it is to be distinctly understood that this invention is not limited thereto but may be variously embodied without departing from the intended scope of the present invention. From the foregoing description, it will be apparent that various changes may be made without departing from the spirit and scope of the invention as defined by the following claims.

What is claimed is:

1. A method of securing a barrel having an annular flange proximate to a rear end of said barrel, to a firearm using a barrel nut, a locknut and a fixture which is configured to receive a receiver of the firearm and the barrel nut and restrain both from rotational movement, the receiver having an externally threaded front end part which is configured to be threadedly engaged within a rear end of the barrel nut, the barrel nut having an internally threaded central bore that receives a chamber end of the barrel and a bushing with a bore therethrough which aligns with an opening located on a front face of the firearm receiver, the bore in the bushing and the opening in the front face of the firearm receiver being configured to receive a part of the firearm's operating system therein, the locknut being configured to slide onto and down the barrel and having external threads to threadedly engage with internal threads on a front end of the barrel nut bore, the method comprising the steps of:

threadedly securing the barrel nut about the externally threaded front end part of the receiver, the barrel nut being rotated at least one complete revolution, until the bore in the bushing aligns with the opening in the front face of the receiver;

securing the fixture about at least the receiver of the firearm and a portion of the barrel nut, said barrel nut having an external structure configured to engage with said fixture and prevent rotation of said barrel nut while torque is being applied to the locknut to secure the barrel to the receiver;

inserting the chamber end of the barrel into the barrel nut until the barrel seats into place against an abutting face on the firearm receiver and the annular flange is contained within the central bore of the barrel nut;

sliding the locknut down the barrel toward the chamber end of the barrel and threadedly securing the locknut to the barrel nut by rotating the locknut until the locknut comes to rest against the annular flange on the barrel; and tightening said locknut against said annular flange to a preset torque value.

2. The method of claim 1, further comprising the step of using a vice to secure the fixture in place and prevent unintentional movement thereof.

3. The method of claim 1, further comprising the step of using a wrench with a crescent shaped head having a plurality of teeth projecting from an inner periphery configured to engage with grooves formed on a forward face of the locknut, the wrench being used to rotate and secure the locknut against the annular flange of the barrel.

* * * * *